United States Patent [19]

Higuchi et al.

[11] Patent Number: 4,926,505

[45] Date of Patent: May 22, 1990

[54] TOILET SEAT STRUCTURE CAPABLE OF AUTOMATICALLY FEEDING SEAT COVERING PAPER ON TOILET SEAT

[75] Inventors: Mitsuhiro Higuchi; Hirofumi Yamamoto, both of Kitakyushu; Osamu Yamamoto, Kasugai; Shokichi Fujii, Kasugai; Katsumi Nonomura, Kasugai, all of Japan

[73] Assignee: Toto Ltd., Kasugai, Japan

[21] Appl. No.: 271,134

[22] Filed: Nov. 14, 1988

[30] Foreign Application Priority Data

Nov. 20, 1987 [JP] Japan ..... 62-294476
Aug. 3, 1988 [JP] Japan ..... 63-195131

[51] Int. Cl.[5] ..... A47K 13/18
[52] U.S. Cl. ..... 4/247
[58] Field of Search ..... 4/247

[56] References Cited

FOREIGN PATENT DOCUMENTS 2310164 9/1974 Fed. Rep. of Germany ..... 4/247
0618085 7/1980 Switzerland ..... 4/247

*Primary Examiner*—Charles E. Phillips
*Attorney, Agent, or Firm*—Jordan and Hamburg

[57] ABSTRACT

A toilet seat structure capable of automatically feeding a seat covering paper onto a toilet seat substantially comprises a seat covering paper roll disposed at the rear end of a toilet seat body, a seat covering paper feeding mechanism which is provided with a press plate, a seat covering paper tearing mechanism, a control unit for controlling the seat covering paper feeding mechanism and the seat covering paper tearing mechanism and tension applying means for applying tension to the seat covering paper, wherein the seat covering paper which is subjected to tension is cut by applying a pressure thereto by means of the press plate. Due to such construction, the tearing edge of the press plate can be formed in a round shape so that wear of the cutting edge which is generated through the tearing operation can be miminized whereby maintenance or repairing can be also minimized.

28 Claims, 15 Drawing Sheets

TOILET SEAT STRUCTURE CAPABLE OF AUTOMATICALLY FEEDING SEAT COVERING PAPER ON TOILET SEAT

STATE OF ART

This invention relates to a toilet seat structure capable of automatically feeding a seat covering paper onto a toilet seat.

TECHNICAL BACKGROUND

Conventionally, there is known a toilet seat covering paper feeding apparatus for setting a seat covering paper on the toilet seat hygienically such as the one disclosed in Japanese Utility Model-Laid Open Publication No. 155399/1985.

This apparatus comprises a seat covering paper roll holder for storing continuous seat covering papers arranged in such a size and shape as to be capable of covering the upper surface of the toilet seat and being taken up in a sheet form or in a folded form, a seat covering paper feeding mechanism provided with a feed roller for feeding forward the seat covering paper a predetermined length onto the upper surface of the toilet seat, and a seat covering paper cutting mechanism provided with a sharp cutting blade for cutting the rear end of the seat covering paper thus fed.

In the conventional apparatus as described above, the feeding and cutting operations of the seat covering paper are carried out by turning on an operation switch to rotate the feed roller or to elevate the cutter.

In the above construction, the cutting of the seat covering paper is carried out by shearing, namely, by slidably moving a movable blade having a sharp cutting edge or ridge relative to a fixed blade also having a sharp cutting edge or ridge.

After cutting the seat covering paper with such blades, for example, thousands of times, the cutting edges of these blades become rounded thus deteriorating the cutting performance.

Furthermore, in spite of the fact that the movable blade and the fixed blade are disposed at the rear portion of the toilet seat which is subjected to the splashing water, the movable blade and the fixed blade are both made of metal such as carbon steel to obtain the sharp cutting edges. Therefore, the cutting edges of the movable blade and the fixed blade become corroded thus deteriorating the cutting or shearing performance from this point of view as well.

For maintaining favorable cutting or shearing performance, the cutting edges of the movable blade and the fixed blade must be ground periodically. This grinding operation, however, takes considerable time and effort making the maintenance operation considerably cumbersome.

Accordingly, it is an object of the present invention to provide a toilet seat structure capable of automatically feeding a seat covering paper onto a toilet seat which can overcome the above drawbacks of the conventional apparatus, wherein the seat covering paper is torn by pressure applied onto the seat covering paper by the pressing of a press plate but not by the conventional shearing force so that the sheet tearing mechanism virtually can be set free from the maintenance for many years.

It is another object of the present invention to provide a toilet seat structure capable of automatically feeding a seat covering paper on a toilet seat which can prevent dirty water such as splashed flushing water from entering into the functional casing which accommodates various mechanisms such as the seat covering feeding mechanism and seat cover tearing mechanism or the control unit so that damage or malfunction of the mechanisms or the control device in the functional casing can be effectively prevented.

It is still another object of the present invention to provide a toilet seat structure capable of automatically feeding a seat covering paper onto a toilet seat wherein the seat covering paper feeding mechanism is incapable of feeding the seat covering paper so long as the user sits on the seat body whereby the feeding of the paper by error or mischievously can be prevented and entanglement of the seat covering paper in the casing body can be prevented.

It is a further object of the present invention to provide a toilet seat structure capable of automatically feeding a seat covering paper onto a toilet seat wherein the seat covering paper is held clamped until the user stands up from the seat body after using the toilet so that displacement of the seat covering paper or sticking of the seat covering paper to the buttocks can be prevented.

It is a still further object of the present invention to provide a toilet seat structure capable of automatically feeding a seat covering paper onto a toilet seat wherein after the seat covering paper is torn, the rear end of the seat covering paper cut is held firmly so that falling of the seat covering paper from the seat body due to a breeze can be effectively prevented and the user uses the toilet without being bothered by the falling off of the seat covering paper.

It is a still further object of the present invention to provide a toilet seat structure capable of automatically feeding a seat covering paper onto a toilet seat wherein any problems with the seat covering paper such as clogging of the seat covering paper in the functional casing or using up of the seat covering paper are effectively solved, namely, the clogged paper can be readily removed from the functional casing and a new seat covering paper roll is readily set in the functional casing.

It is a still further object of the present invention to provide a toilet seat structure capable of automatically feeding a seat covering paper onto a toilet seat wherein in case the seat covering paper fed onto the seat body is twisted or becomes wet with, splashed water so that the paper is not usable, the clamping of the seat covering paper is readily released and the seat covering paper can be readily removed from the seat body and discarded into the toilet bowl so that a fresh seat covering paper can be fed onto the seat body to facilitate the usability of the toilet.

It is a still further object of the present invention to provide a toilet seat structure capable of automatically feeding a seat covering paper onto a toilet seat wherein when the seat covering paper roll cover is to be opened for replacement of the seat covering paper roll or for the removal of clogged seat covering paper, the power source is turned off so as to stop the operation of all the mechanisms in the functional casing, whereby the paper roll replacement operation or the removal of the clogged paper can be readily carried out.

In summary, the present invention discloses a toilet seat structure capable of automatically feeding a seat covering paper onto a toilet seat comprising (a) a seat covering paper roll in a seat covering paper roll protection cover disposed at the rear of a toilet seat body, (b) a seat covering paper feeding mechanism for feeding a seat covering paper from the seat covering paper roll to the upper surface of the seat body, (c) a seat covering paper tearing mechanism for tearing the seat covering paper after delivery, and (d) a control unit for controlling the seat covering paper tearing mechanism, wherein the improvement is characterized in that the toilet seat structure further comprises tension applying means for applying tension to the seat covering paper and the seat covering paper tearing mechanism comprises a press plate which is capable of applying pressure on the tensioned seat covering paper for tearing the seat covering paper.

In the above construction, for facilitating the tearing of the seat covering paper, the seat covering paper may preferably be provided with a plurality of breaking lines each of which is made of a multiplicity of small perforations formed continuously and transversely on the entire width of the seat covering paper.

Due to such construction, the present invention has the following advantages.

(1) Without using the shearing force exerted by the sliding movement of a movable blade relative to a fixed blade, the seat covering paper is torn by a pressure applied by the press plate on and along the breaking lines disposed at regular intervals on the seat covering paper.

Accordingly, the tearing edge of the press plate can be formed in a round shape so that the wear of the tearing edge which is generated through the tearing operation can be minimized whereby maintenance or repairing can be also minimized.

(2) Without using the shearing force exerted by sliding movement of a movable blade relative to a fixed blade, the seat covering paper is cut by pressure applied by the press plate on and along the breaking lines disposed at regular intervals on the seat covering paper.

Accordingly, the tearing edge of the press plate can be formed in a round shape and the press plate can be made of plastics or ceramics which do not corrode. Therefore, the prevention of the occurrence of wear of the tearing edge can be promoted whereby maintenance or repairing can be further minimized.

Best Mode for Carrying Out the Invention

Hereinafter, the present invention will be described in detail with reference to its embodiment shown in the accompanying drawings.

Figure 1:
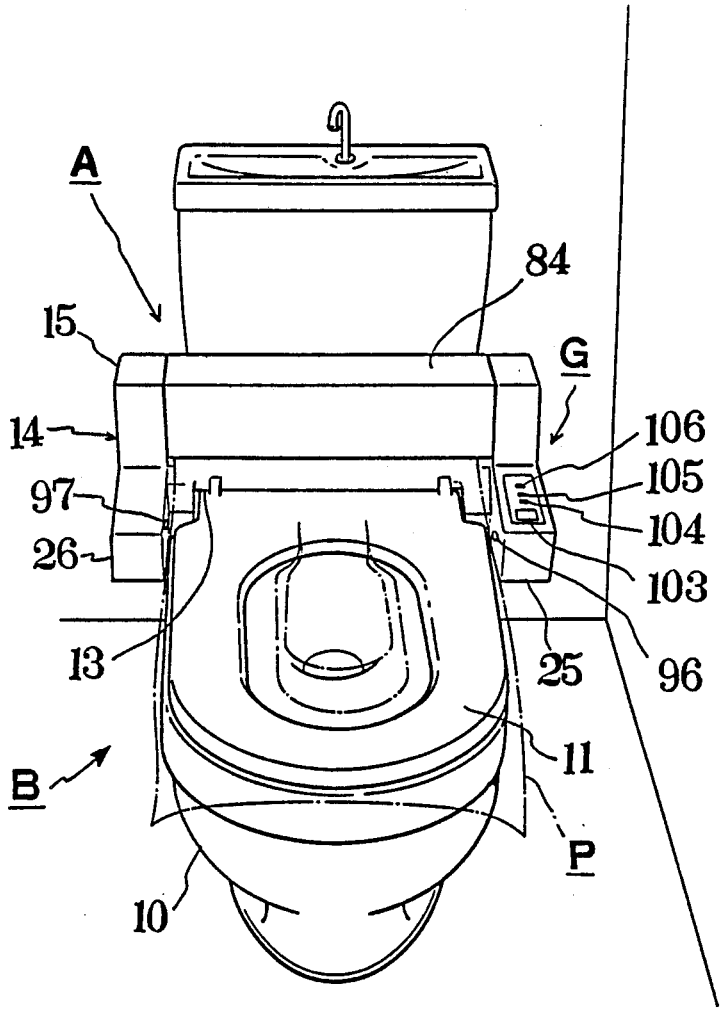
FIG. 1 is an overall perspective view of a toilet device equipped with a seat covering paper automatic feeding seat in accordance with the present invention.
Figure 2:
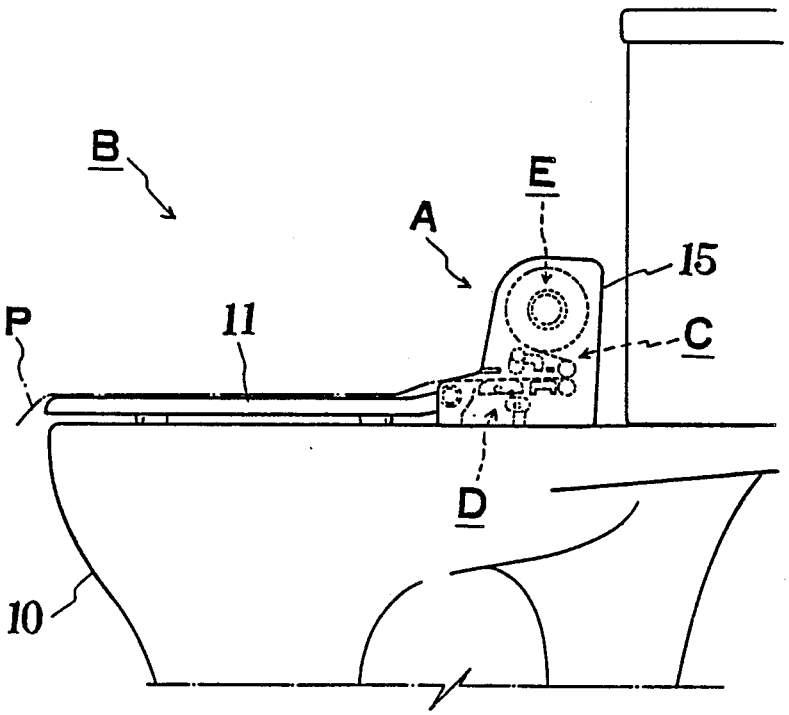
FIG. 2 is a partial side view of the toilet device.

FIGS. 1 and 2 show the overall structure of a toilet device B equipped with the seat covering paper automatic feeding toilet seat A in accordance with the present invention.

As shown in the drawing, the seat covering paper automatic feeding toilet seat A is placed on a flush toilet 10 constituting the toilet device B.

The structure of the seat covering paper automatic feeding toilet seat A will be described in detail with reference to FIGS. 1 to 5.

Figure 3:
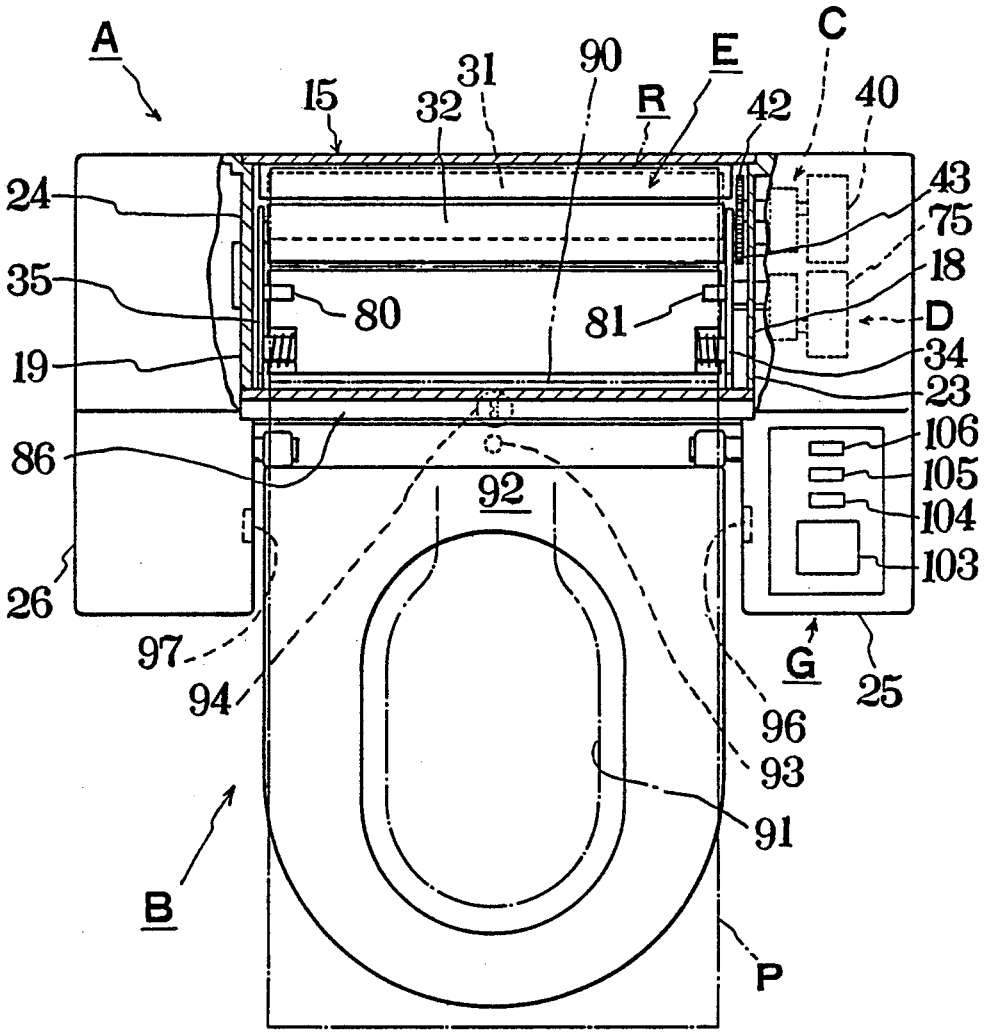
FIG. 3 is a partial cut-away plan view of the toilet device.
Figure 4:
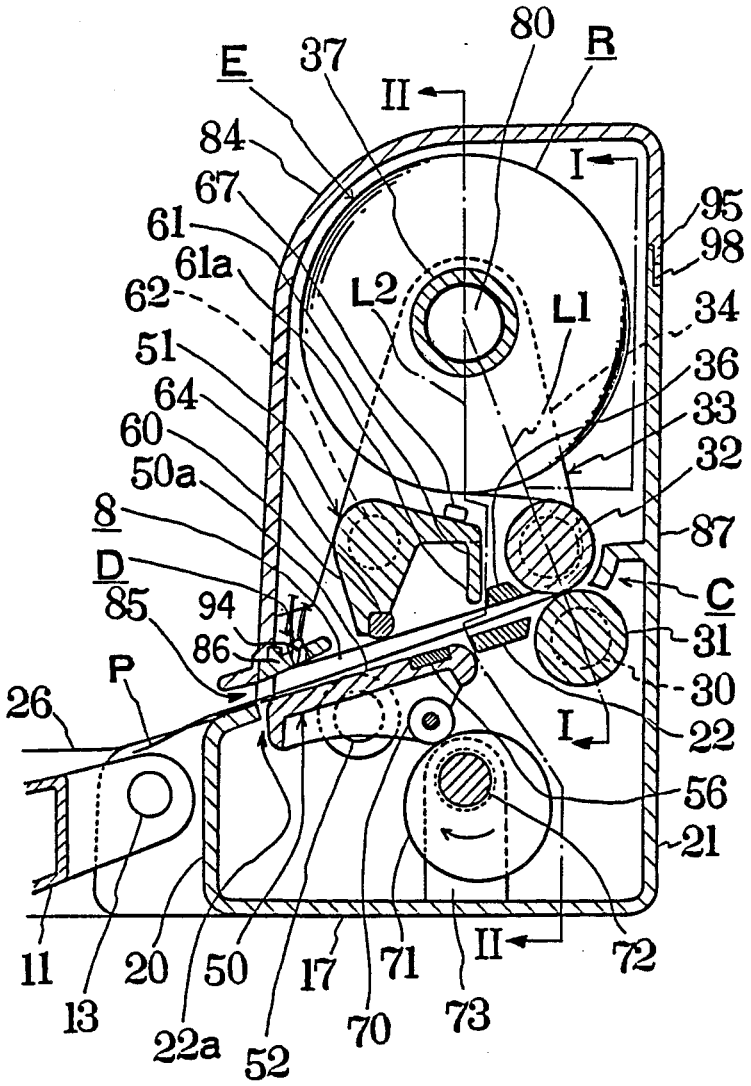
FIG. 4 is a partial cut-away right-side view of the toilet device.
Figure 5:
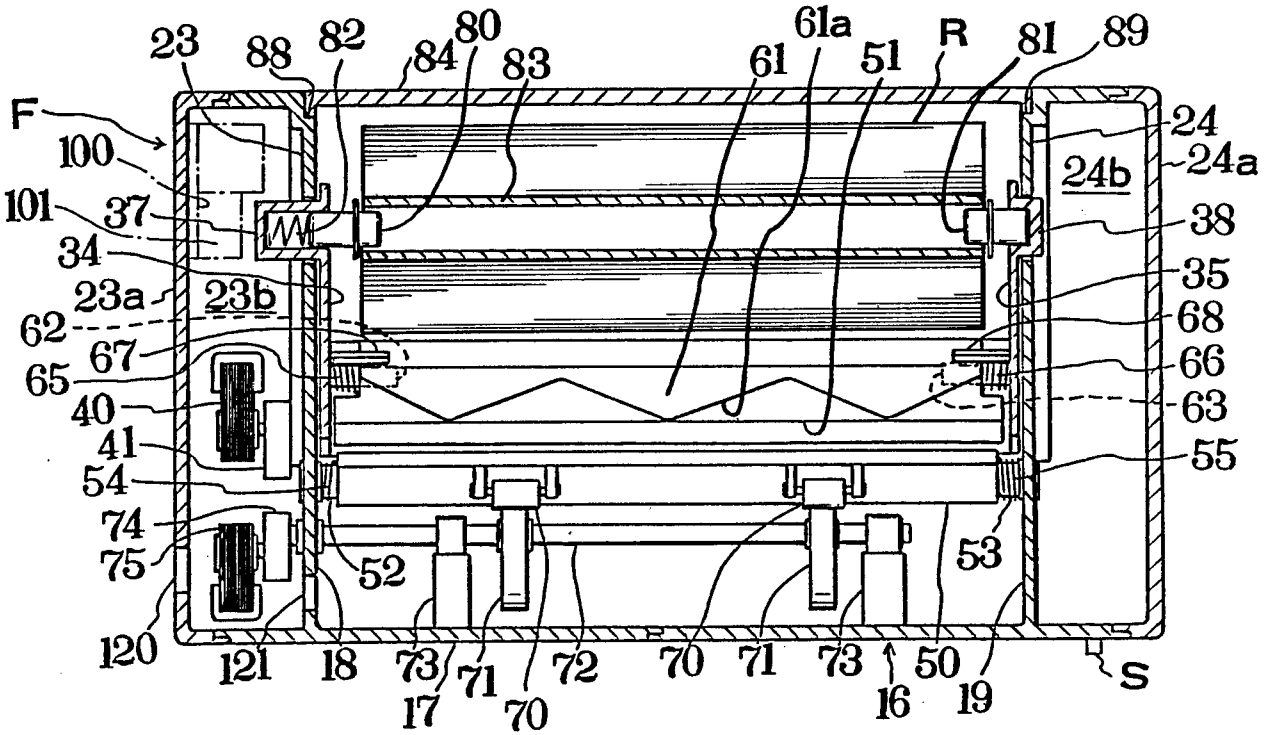
FIGS. 5 and 6 are sectional views of the toilet device taken along the line II—II and the line I—I of FIG. 4, respectively.

As shown in FIGS. 3 to 5, a functional unit consists of a functional unit casing 15 fitted to the rear part of the flush toilet 10 and a seat covering paper feeding mechanism C, a seat covering paper tearing mechanism D, a seat covering paper roll storage unit E, a control unit F and an operation unit G all of which are disposed inside the functional unit casing 15.

First of all, the structure of the functional unit casing 15 will be explained.

Reference numeral 16 represents a box-shaped main casing frame consisting of a rectangular fitting plate 17 extending to the right and left when viewed in plan, right and left side walls 18,19 and front and rear walls 20,21 fitted around the periphery of the fitting plate 17 and an inclined ceiling 22 disposed on the fitting plate 17 and being high at the front and low at the rear.

Figure 7:
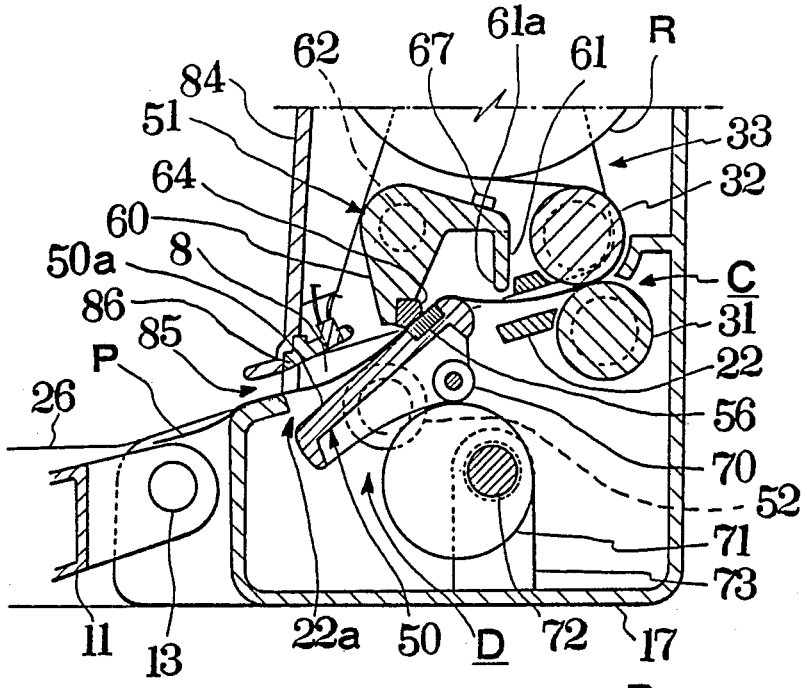
FIGS. 7 to 10 are explanatory views useful for explaining the operation state of a seat covering paper tearing mechanism.

A portion of seat covering paper feeding path 8 (referenced is a subsequent Figure, viz. Fig. 7) is defined on the upper surface of the inclined ceiling 22 of the main casing frame 16 and a rectangular plate insertion space **22*a* for inserting movable plate 50 is defined at the front part of the inclined ceiling 22**.

Longitudinal seat covering paper roll fitting walls 23,24 project from the casing main frame 16 on both its sides in order to define a seat covering paper roll storage space above the casing main frame 16 and the lower part of each fitting wall 23,24 is integrally connected to each of the right and left side walls 18,19 of the main casing frame 16.

As shown in FIG. 5, outer walls **23*a*,24*a* are disposed at the outside of the seat covering paper roll fitting walls 23,24 respectively and motors 40,75 for feeding and tearing the seat covering paper P and the control unit F are stored in the chambers 23*b*,24*b* defined between the fitting walls 23,24 and the outer walls 23*a*,24*a***.

As shown in FIGS. 3 and 4, extension portions 25,26 are formed on the seat covering paper roll fitting walls 23,24 and on the outer walls **23*a*,24*a* in such a manner that their front portions extend from the front wall of the main casing frame 16, and the base end side of the seat body 11 is rotatably supported by a pair of shafts 13 at both extension portions 25,26**.

Next, the seat covering paper feeding mechanism C and the seat covering paper tearing mechanism D that are stored in the functional unit casing 15 will be described.

First of all, the seat covering paper feeding mechanism C will be explained.

As shown in FIGS. 3 to 5, a seat covering paper feed shaft 30 is supported rotatably and transversely between the rear upper portions of the right and left side walls 18,19 of the main casing frame 16 and a seat covering feed roller 31 which has substantially the same length but has a different diameter from that of the feed shaft 30 is integrally fixed thereto.

As shown in FIG. 4, the feed roller 31 presses and clamps the pull-out end of the seat covering paper P in cooperation with a clamp roller 32 disposed above the former, and can feed and supply the seat covering paper P from the seat covering paper roll storage unit E to the seat body 11.

In FIGS. 4 and 5, reference numeral 33 represents a suspension support frame which has a U-shape when viewed from the front and consists of right and left rocking arms 34,35 and a connection plate 36 connecting the lower ends of both arms 34,35. The upper ends of the right and left rocking arms 34,35 of the suspension support frame 33 are fitted through cylindrical bosses 37,38 to the seat covering paper roll fitting walls 23,24 in such a manner as to be capable of rocking in a forward or backward direction.

The clamp roller 32 described above is fitted into the roller fitting space defined between the lower ends of the right and left rocking arms 34,35 of the suspension support frame 33.

Incidentally, the line L1 connecting the axes of the cylindrical bosses 37,38 supporting rotatably the right and left rocking arms 34,35 of the suspension support frame 33 to axis of the clamp roller 32 is inclined with respect to the normal L2 extended downward from the cylindrical bosses 37, 38 as shown in FIG. 4 so that under a normal contact state, the clamp roller 32 is brought into pressure contact with the feed roller 31 and can clamp the seat covering paper P with a pressure suitable for feeding.

Figure 6:
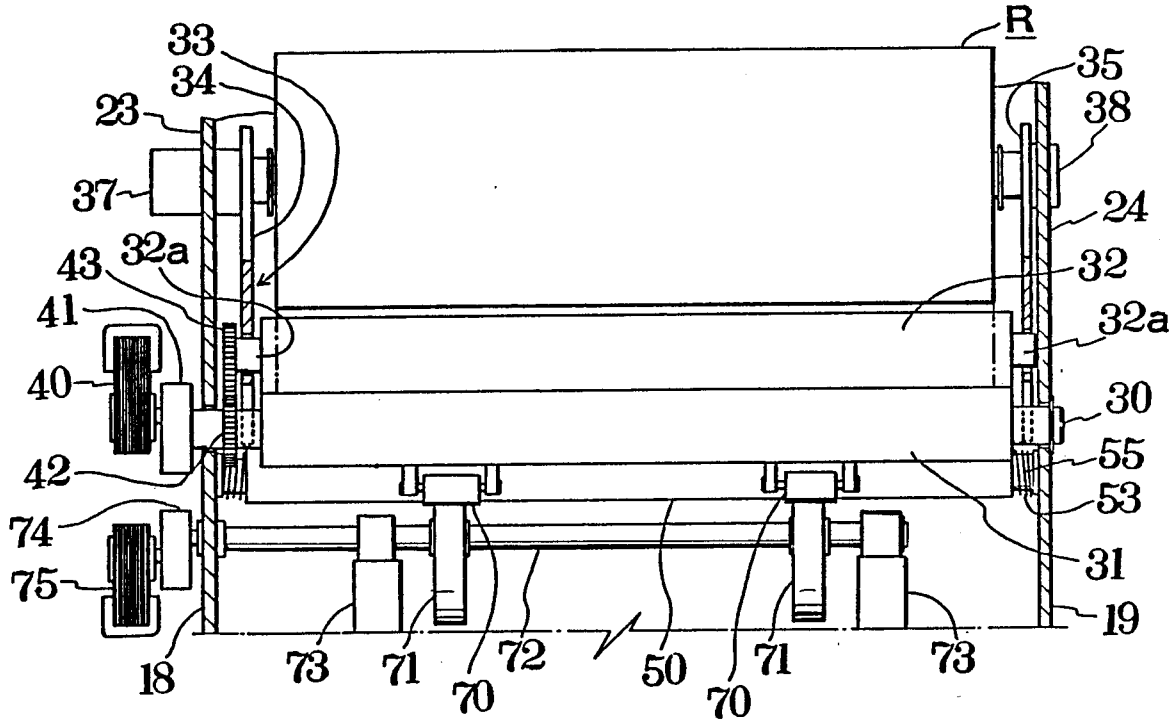

In FIGS. 5 and 6, reference numeral 40 represents a rotary motor disposed in the chamber **23*b*. The output shaft of the motor 40 is connected to the left end of the seat covering paper feed shaft 30 through a reduction gear 41**.

Transmission gears 42,43 are fixed to the left end of the seat covering paper feed shaft 30 and to the left end of the roller fitting shaft **32*a* of the clamp roller 32** and can mesh with each other.

Therefore, when the seat covering paper feed shaft 30 is rotated by the motor 40, the clamp roller 32, too, is rotated integrally with the feed roller 31 through the transmission gears 42,43, delivers the seat covering paper P out from the seat covering paper roll R stored in the seat covering paper roll storage unit E and feeds it onto the seat body 11 through a seat covering paper feed path 8 defined on the upper surface the inclined ceiling 22 of the main casing frame 16 and the lower surface of the suspension support frame 33.

As will be described later, the seat covering paper P is clamped between the feed roller 31 and the clamp roller 32, and since both rollers 31,32 engage with each other through the transmission gears 42,43 in this case, the rotation not only of the feed roller 31 but also of the clamp roller 32 can be prevented reliably so long as the motor 40 is off, and the loosening of the clamp force due to the slip of the clamp roller 32, or the like, can be prevented reliably.

Next, the structure of the seat covering paper cutting mechanism D will be explained.

As shown in FIG. 4, the seat covering paper cutting mechanism D in this embodiment consists of a movable plate 50 adapted to be capable of rocking into the plate insertion space **22*a* defined in front of the inclined ceiling of the main casing frame 16 and a rocking plate 51 disposed above the movable plate 50 and supported rotatably between the lower ends of the right and left rocking arms 34,35 of the suspension support frame 33**.

In the first place, the structure of the movable plate 50 will be explained.

As shown in FIGS. 4 and 5, the movable plate 50 consists of an elongated and wide rectangular flat sheet extending to the right and left, and pivot shafts 52,53 are formed so as to extend from its both ends and are supported rotatably on the right and left side walls 18,19 of the main casing frame 16.

Reference numerals 54 and 55 represent bias springs fitted to the pivot shafts 52, 53 in order to bring always a guide roller 70 into pressure contact with a disc cam 71.

Reference numeral 56 represents a seat covering paper clamping plate made of a flexible material. It is disposed at the rear part of the upper surface **50*a* of the movable plate 50 and clamps the seat covering paper P in cooperation with a seat covering paper clamping plate 64 of the rocking plate 51**.

When the seat covering paper P is fed onto the seat body 11, the upper surface **50*a* of the movable plate 50 is made to be substantially parallel to the upper surface of the inclined ceiling 22 as shown in FIG. 4 to form a corresponding portion of the seat covering paper feed path 8**.

As will be described later, the movable plate 50 is rotated around the pivot shafts 52, 53 when the seat covering paper P is cut so that it assumes the rotated positions shown in FIGS. 7 to 9.

Figure 10:
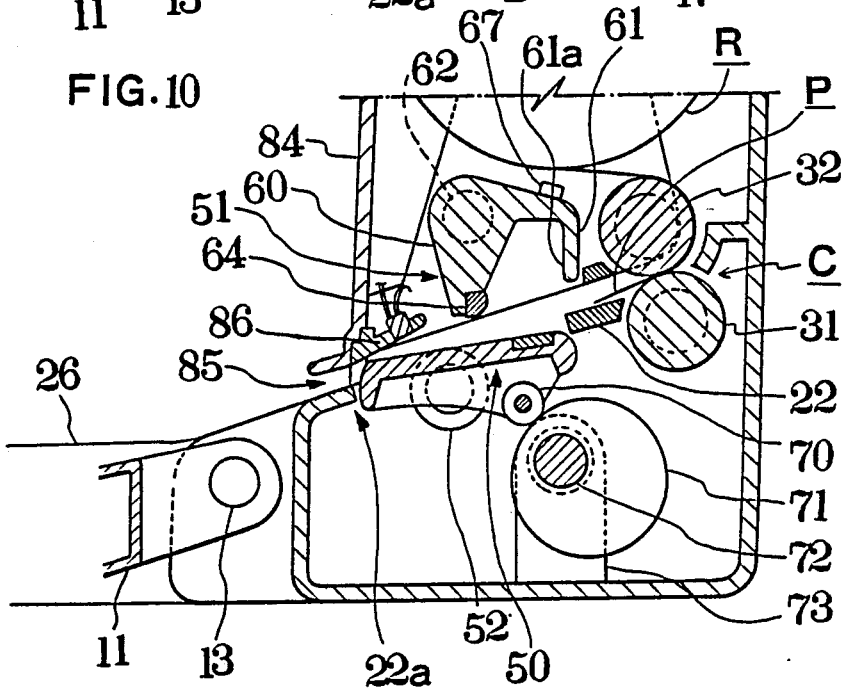

Futhermore, when the toilet seat is not used, it is possible to let the movable plate 50 assume the rotated position shown in FIG. 10.

Next, the structure of the rocking plate 51 which tears the seat covering paper P in cooperation with the movable plate 50 will be explained.

As shown in FIG. 4, the rocking plate 51 has a thick seat covering paper clamping portion 60 and a thin seat covering paper tearing portion 61 when viewed from the side, and has an inverse U-shaped sectional shape opening downward.

In the above construction, thin seat covering paper tearing portion 61 works as a press plate with the lower extremity **61*a*** thereof functioning as a tearing blade which is capable of breaking, i.e., controlledly tearing, the seat covering paper P as described later.

Pivot shafts 62, 63 are formed to project from both upper ends of the seat covering paper clamping portion 60 of the rocking plate 51 and are supported rotatably at the front lower ends of the right and left rocking arms 34, 35 of the suspension support frame 33.

A seat covering paper clamping plate 64 of a flexible material is fitted to the lower end of the seat covering paper clamping portion 60 of the rocking plate 51 and can clamp the seat covering paper P without slippage.

Return springs 65, 66 are fitted to the pivot shafts 62, 63 and always urge the rocking plate 51 in a counterclockwise direction in FIG. 4.

They can keep the rocking plate 51 at a stand-by position shown in FIG. 4, that is, at a position with the tearing blade **61*a* poised above the seat covering paper P at the rear of the seat covering paper feed path 8, in cooperation with stoppers 67, 68 formed to project from the inner surfaces of the seat covering paper roll fitting walls 23, 24**.

Next, various forms can be employed, in principle, as a driving mechanism of the seat covering paper tearing mechanism D consisting of the movable plate 50 and the rocking plate 51 but this embodiment uses the mechanism shown in FIGS. 4 to 6.

Namely, the guide roller 70 is fitted to the movable plate 50 at a position eccentric rearward from the pivot shafts 52, 53 at the lower part of the movable plate 50.

The disc cam 71 is disposed below the guide roller 70 in such a manner as to come into rotatable contact with the guide roller 70 and to move the guide roller 70 up and down as the rotation of the disc cam 71 rotates the guide roller 70.

A rotary shaft 72 to which the disc cam 71 is fixed is supported rotatably at its both ends by a pair of bearing beds 73 surmounting the rectangular fitting plate 17 of the casing main frame 16.

The extension portion formed on one side of the rotary shaft 72 passes through the left sidewall 18 and extends into the chamber **23*b* defined between the seat covering paper roll fitting wall 23 and the outer wall 23*a*. This extension portion is connected with the motor 75 through a reduction gear 74**.

In the structure described above, when the motor 75 is driven, the rotary shaft 72 rotates and the disc cam 71 integral with the rotary shaft 72 rotates, too, with the axis of the rotary shaft 72 being the center of rotation.

Since the center of the disc cam 71 is eccentric with the axis of the rotary shaft 72, the contact of the peripheral surface of the disc cam 71 with the guide roller 70 moves the guide roller 70 up and down.

Due to this up and down movement, the movable plate 50 is rocked about the pivot shafts 52, 53, and the rocking plate 51 is rocked by the rocking of the movable plate 50 so that the seat covering paper P can be torn efficiently in the following way.

First, in FIG. 4, the seat covering paper P is delivered onto the seat body 11 through the seat covering paper feed path 8 due to the rotation of the feed roller 31 and clamp roller 32 that are driven by the seat covering paper feeding mechanism C described already.

Thereafter the seat covering paper P is fed out in such a manner that a breaking line 90 which is made of a multiplicity of perforations (see FIG. 3) comes substantially immediately below the tearing blade **61*a*** of the seat covering paper cutting mechanism D.

Next, when the motor 75 is driven to rotate the disc cam 71 clockwise, the movable plate 50 is rotated counter-clockwise about the pivot shafts 52, 53 by the engagement of the disc cam 71 with the guide roller 70, and the seat covering paper clamping plate 56 clamps the seat covering paper P in cooperation with the seat covering paper clamping plate 64 of the rocking plate 51.

The portion of the seat covering paper P positioned between this clamped portion and the clamped portion at the nip of the feed roller 31 and the clamp roller 32 is pressed and bent upwardly by the rear end of the movable plate 50 to apply a tension to the seat covering paper P.

The feed roller 31 and the clamp roller 32 are engaged with each other by the transmission gears 42, 43 as described already, and moreover, the movable plate 50 and the rocking plate 51 clamp the seat covering paper P through the seat covering paper clamping plates 56, 64. Therefore, any slippage at the clamping portions is prevented reliably.

Figure 8:
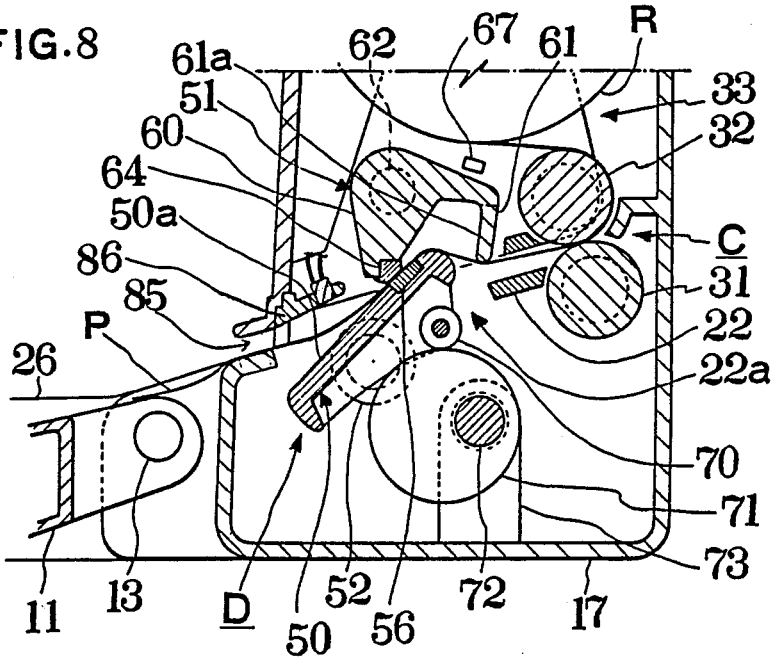

Thereafter, when the disc cam 71 is rotated further clockwise, the movable plate 50 rotates counter-clockwise as shown in FIG. 8, on one hand, and rotates clockwise the rocking plate 51, on the other.

Therefore, the tearing blade **61*a* at the tip of the seat covering paper cutting portion 61 of the rocking plate 51** presses down the seat covering paper P and applies further a tension thereto.

Figure 9:
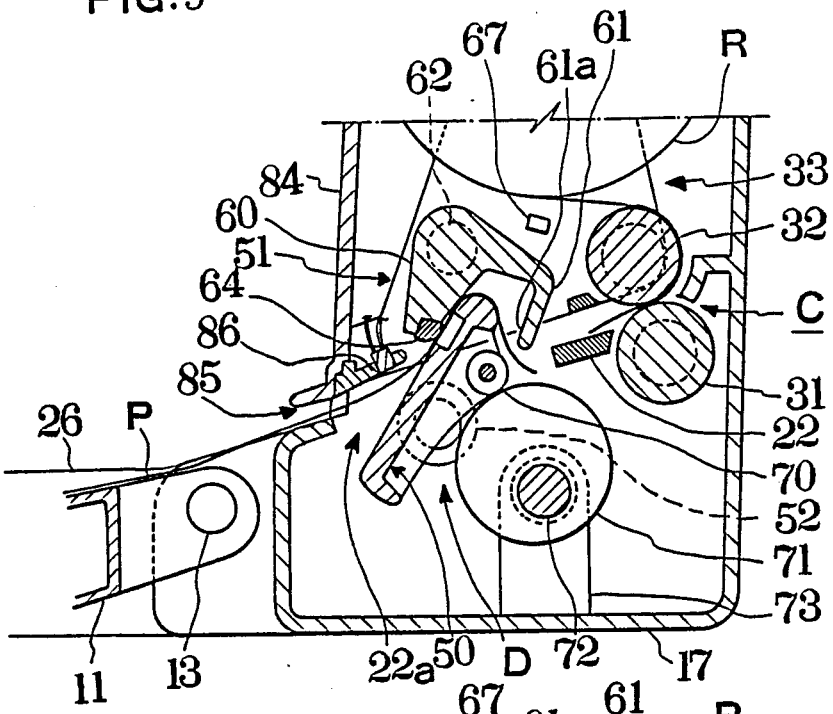

When the disc cam 71 is rotated further clockwise as shown in FIG. 9, the movable plate 50 further rotates counter-clockwise while the rocking plate 51 further rotates clockwise and due to this rotation, the tearing blade **61*a* of the seat covering paper tearing portion 61 of the rocking plate 51** further presses down the seat covering paper P and applies further tension thereto.

As a result, the seat covering paper P is torn, i.e., controlledly broken at its breaking line 90. After being torn, the seat covering paper P is kept clamped by the clamp plates 56, 64.

When the user of the toilet leaves the seat body 11, his motion is detected by a seating detection means 96, and when its output signal is sent to the control unit F, the disc plate 71 further rotates clockwise and the movable plate 50 rotates clockwise this time, thereby releasing the clamping of the seat covering paper P and assuming the position shown in FIG. 10.

In this manner, prevented effectively is the inflow of the splash water after the use of the toilet into the seat covering paper feed path 8, because in the position shown in FIG. 10, the front end of the plate 50 substantially fills the space **22*a* and thereby substantially blocks communication between seat covering paper outlet port 85 and the interior of the casing 15**.

Incidentally, because the tearing of the seat covering paper P is made by applying the tension and press force to the seat covering paper P, there is no need to form the seat covering paper tearing portion 61 of the rocking plate 51 or its tearing blade **61*a*** as a sharp metal blade or the like. In other words, they may be in the form of a dull ceramic blade or a corrosion-resistant and wear-resistant synthetic resin blade having a round edge.

Therefore, frequent replacement of the rocking plate 51 due to corrosion and wear is prevented even in the course of use for an extended period and maintenance is improved.

Similarly, it is possible to form the movable plate 50 of a corrosion-resistant and wear-resistant synthetic resin or ceramic.

Cutting performance can be improved by forming the cutting blade **61*a* in a serrated form as shown in FIG. 5**.

Next, the seat covering paper roll storage unit E disposed above the main casing frame 16 which accommodates the seat covering paper feed mechanism C and the seat covering paper cutting mechanism D will be explained.

In FIGS. 4 and 5, reference numerals 80 and 81 represent support rods fitted into the bosses 37, 38 of the suspension support frame 33, the boss 37 being equipped therein with a spring 82. Both ends of a hollow roll core 83 which is provided with the seat covering paper roll R on the outer peripheral surface thereof can be fitted and supported rotatably by these support rods 80, 81.

Reference numeral 84 represents a seat covering paper roll protection cover which is disposed on the main casing frame 16 to enclose the seat covering paper roll R described above. Its front lower end is rotatably engaged with the supported on a cover support plate 86 extending between the front lower ends of the right and left rocking arms 34, 35 of the suspension support frame 33 and its rear lower end is engaged with and supported by the upper end of the extension rear end wall 87 at the upper part of the rear wall 21 of the casing main frame 16.

Figure 11:
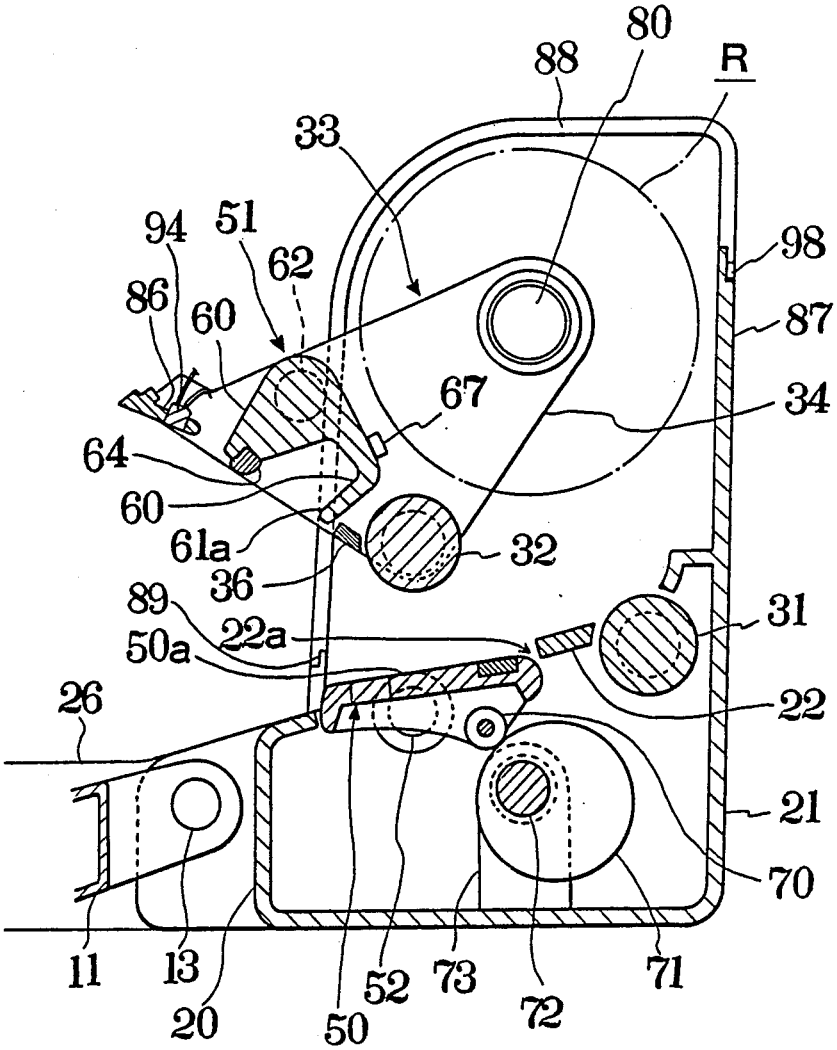
FIG. 11 is an explanatory view useful for explaining the rocking forward of a suspension support frame.

As shown in FIGS. 5 and 11, both side ends of the seat covering paper roll protection cover 84 are engaged with fitting grooves 88, 89 formed along the inner edges of the seat covering paper roll fitting walls 23, 24.

A projection 95 is formed on the rear inner surface of the protection cover 84 in such a manner as to be able to come into contact with and away from the cover opening/closing detection means 98 such as a micro-switch disposed on the inner surface at the upper edge portion of the extension rear wall 87. When this means 98 is turned ON and OFF, the opening/closing state of the cover 84 can be detected.

In the event that the seat covering paper P becomes entangled in the seat covering paper feed path 8, it can be taken out easily by removing the seat covering paper roll protection cover 84 and then rocking forward the suspension support frame 33.

Next, the seat covering paper P used in this embodiment will be explained. As shown in FIGS. 4 and 5, the seat covering paper P, which is torn for use, constitutes part of the seat covering paper roll R.

The seat covering paper P is formed from the seat covering paper roll R for the following reasons.

First, the seat covering paper P for a large number of people can be stored compactly inside the functional unit 14 disposed at the rear of the seat body 11 and second, it can be fed automatically and accurately onto the upper surface of the seat body 11.

Figure 12:
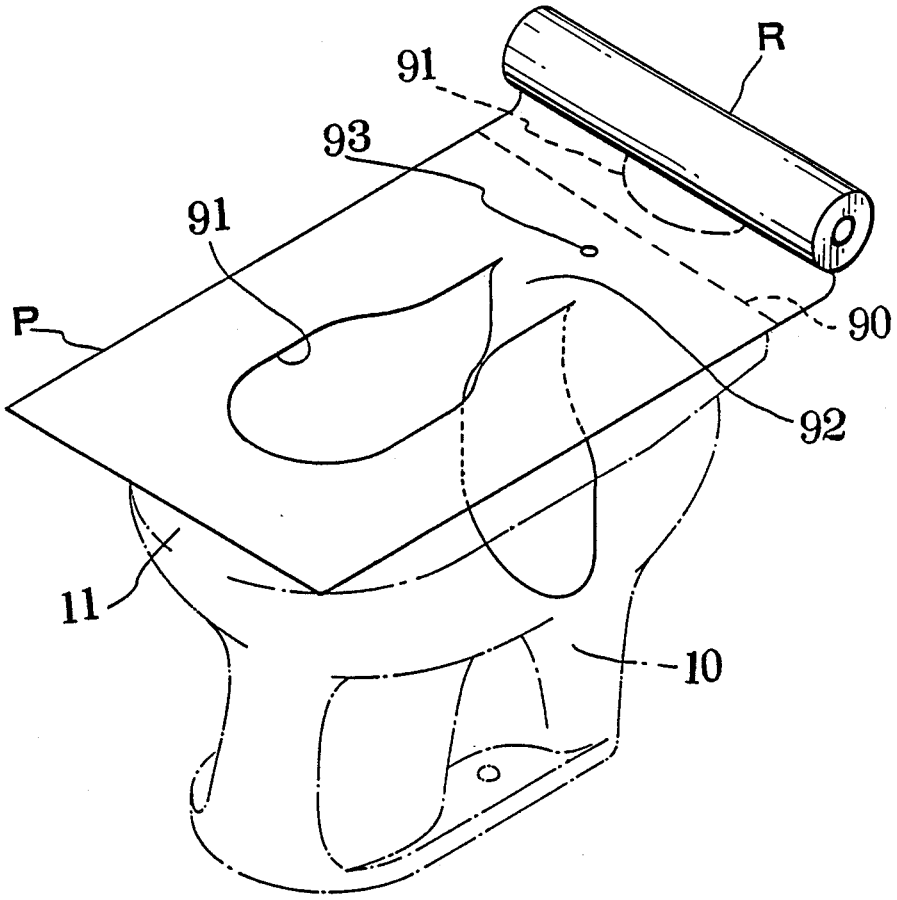
FIG. 12 is an explanatory view useful for explaining the use of the toilet seat.

As shown in FIGS. 3 and 12, the seat covering paper P is provided with the breaking lines 90 made of linear cutting perforations in the transverse direction at predetermined intervals in the longitudinal or feeding direction corresponding to individual seat covers and is cut along this breaking line 90.

Furthermore, the seat covering paper P is provided with a perforated line 91 conforming with the inner shape of the seat body 11 and located at a center portion of the seat covering paper P between each adjacent pair of breaking lines 90, and when the seat covering paper P is torn or broken along perforated line 91, an opening communicating with the inside of the flush toilet 10 formed. However, the perforated line 91 is not completely round or ring-like but a perforation-free portion 92 is formed between a pair of rear ends of the perforated line 61. Therefore, when the perforated line 91 is broken, the thereby formed cut-out center portion is suspended in the toilet 10 with its lower end dipped into the standing water.

The reason why the seat covering paper P is not initially provided with an open, central portion cut-out but is provided with the perforation-free portion 92 and the perforated line 91 is that if the large central openings were completely cut out, the paper P would lose its stiffness and be bent when supplied onto the seat body 11 and, moreover, it would be difficult to form the seat covering paper into the roll R. In other words, the seat covering paper P provided with the perforated line 91 and perforation-free portion 92 has a sufficient stiffness to facilitate both automatic feed and roll formation.

The perforation-free portion 92 of the seat covering paper P can prevent as much as possible the seat covering paper P from being rolled up into the feed roller 31 and the clamp roller 32 when the seat covering paper P is fed.

The perforated line 91 of the seat covering paper P may consist entirely of perforations or partially of perforation with the remainder being cut portions so long as it has a shape which is in conformity with the inner shape of the seat body 11.

Furthermore, as shown in FIGS. 3 and 12, a position detection through-holes 93 are provided at predetermined intervals in the longitudinal direction of the seat covering paper P corresponding to individual seat covers, centrally of and behind the perforation-free portion 92, and a position detection sensor 94 consisting of a light emitting device and a light reception device is disposed at the cover support plate 86 at a position corresponding to the position detection through-hole 93.

The position detection sensor 94 detects the position detection through-hole 93 when the seat covering paper P is fed out from the seat covering paper roll R in a predetermined length, stops the operation of the seat covering paper feed mechanism C, and thereby assures accurate locating of the seat covering paper P on the seat body 11.

Furthermore, the interval between the position detection through-holes 93 at the end portion of the seat covering paper roll R is made shorter than at the other portions so that the end of the roll R can be detected by reducing the intervals of detection of the through-holes 93 by the position detection sensor 94 at the time of feeding of the paper P constituting the end portion of the roll R.

A predetermined color mark may be applied to the seat covering paper P in place of such a through-hole 93 and the positions of the through-holes 93 are not essentially limited to the center of the seat covering paper P but may be located elsewhere provided, of course, the sensor 94 is correspondingly relocated.

Feed and location of the seat covering paper P can be made by counting the number of revolutions of the motor 40 by means of a counter without using the position detection sensor 94 and by operating the control unit F on the basis of the count value.

In FIG. 1, reference numeral 96 represents seating detection means which consists of an infrared sensor or the like and is disposed on the inner surface of one extension portion 25 of the main casing frame 16.

It generates a detection output signal a predetermined time (e.g. 5 seconds) after the user of the seat body 11 leaves the seat body 11 which operates the control unit F to drive the motor 75, resulting in releasing of the clamping of the seat covering paper P and the prevention of the intrusion of contaminated water into the seat covering paper feed path 8 by moving of the movable plate 50 and the rocking plate 51 to the positions shown in FIG. 10 from the positions shown in FIG. 9.

Such seating detection means 96 may be assembled integrally into the seat covering paper automatic feeding toilet seat A or may be a separate device depending on the conditions and environment of use.

Furthermore, it is possible to use, instead of the infrared sensor, a micro-switch or a limit switch, or a load cell for detecting the load of seating of the user as the seating detection means 96.

In FIG. 1, reference numeral 97 represents an abnormal feed prevention sensor for cutting off the supply of power by means of the control unit F and thereby to the motor 40 stopping the supply of the seat covering paper P when the seat body 11 is out of the seating position (such as when it is standing up) and therefore is not detected by the sensor 97. This sensor detects the seat body 11 only when the seat body 11 is in the seating position.

A micro-switch or a limit switch may be used in place of an ordinary sensor as the abnormal feed prevention sensor 97.

Next, the structure of the control unit F for controlling the operations of the seat covering paper feeding mechanism C, the seat covering paper tearing mechanism D and various sensors and detection means will be explained.

As shown in FIG. 5, a control unit fitting plate 100 is installed in the chamber **23*b* formed on one side of the main casing frame 16 and a control board 101 for controlling the operations of the motors 40, 75 is fitted to this control unit fitting plate 100**, thereby constituting the control unit F.

Next, the operation unit G will be explained. As can be best seen from FIGS. 1 and 3, this operation unit G is formed by fitting a power switch S (not referenced in FIG. 1 or 3, see FIG. 13), a seat covering paper feed switch 103, a power lamp 104 consisting of a light emitting diode or the like, a paper resupply (used-up alarm) lamp 105 having an alarm function when abnormality such as clogging or using up of the paper occurs, a paper trouble lamp 106, and the like.

A buzzer may be fitted in place of the paper trouble lamp 106.

Figure 13:
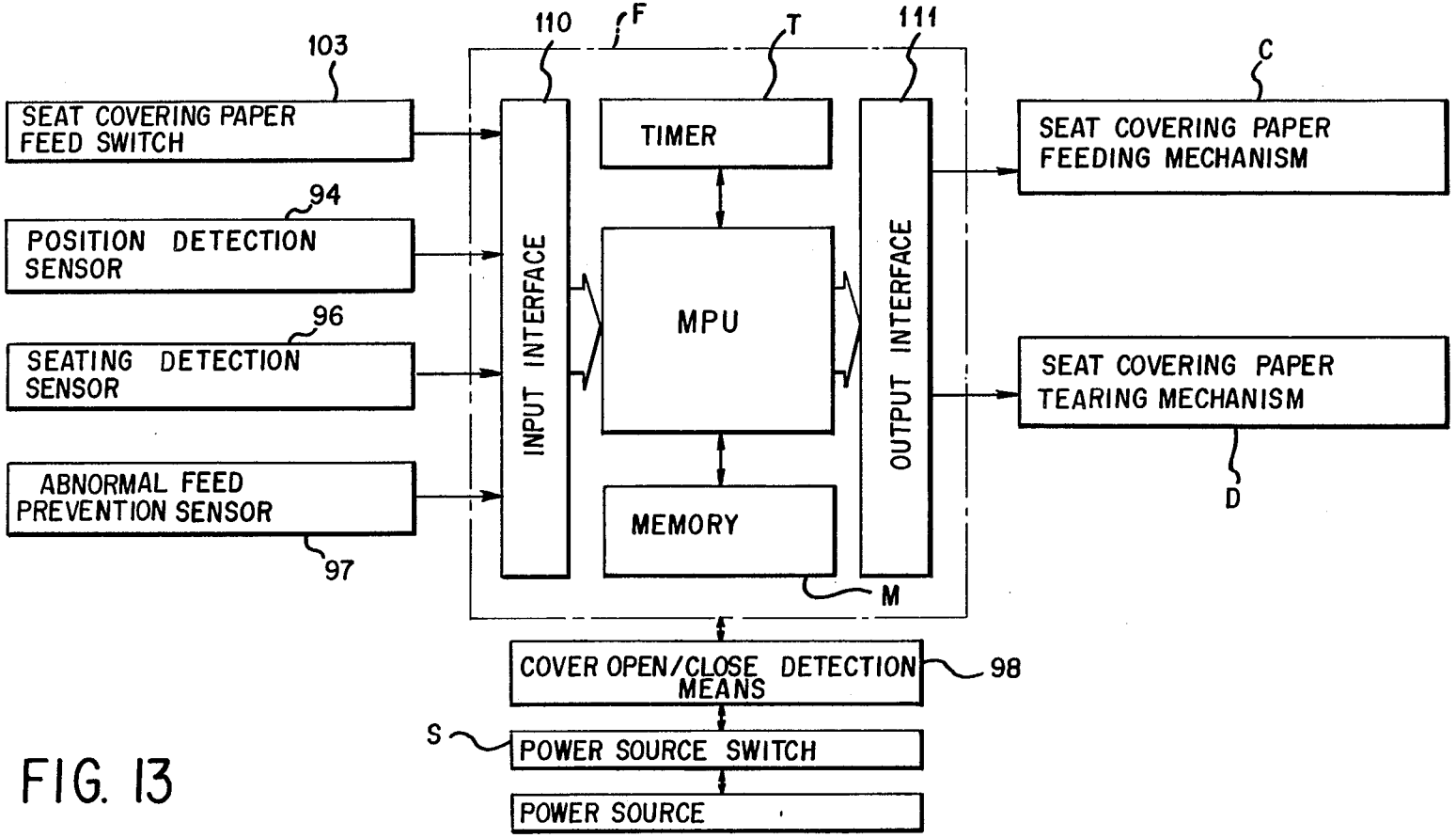
FIG. 13 is a block diagram of a control unit of the seat covering paper automatic feeding seat.

The structure of the control unit F for controlling the seat covering paper automatic feed toilet seat A is shown in FIG. 13.

In FIG. 13, reference numeral 110 represents an interface disposed between the seat covering paper feed switch 103, the position detection sensor 94, the seating detection means 96, etc., and a micro processing unit MPU. Reference numeral 111 represents an output interface disposed between the micro processing unit MPU and the seat covering paper feeding mechanism C, the seat covering paper tearing mechanism C, and the like.

The control unit F also includes a memory M which stores a program of operation control sequence such as shown by the flow charts of FIGS. 14A to 14D. Particularly, the program stores the following operation sequence. Even after the seat covering paper feed push bottom 103 is depressed to feed the seat covering paper P onto the upper surface of the seat body 11 by the seat covering paper feeding mechanism C and the paper P is torn by the seat covering paper tearing mechanism D, the seat covering paper clamping plates 56, 64 keep clamping the paper P and this clamping operation is continued from the input of the signal detecting the seated human body from the seating detection means 96 till the termination of this input signal. This clamping operation is released only after this signal becomes OFF.

Accordingly, it does not happen that the seat covering paper P becomes displaced while the user is seated on the seat body or attaches to the user's buttocks when he stands up after using the toilet.

The control unit F is provided with a timer circuit T which operates simultaneously with the clamping operation of the seat covering paper tearing mechanism D and generates an output signal when the seating detection means 96 does not detect seating after the passage of a predetermined period. This output releases the clamping of the seat covering paper clamping plates 56, 64 described above.

Accordingly, after the seat covering paper P is fed, clamped and torn and this clamping operation is maintained to avoid the aforementioned inconveniences to the user, the clamping is released automatically so that the next user of the toilet can discard the seat covering paper P set onto the seat body 11 and can feed and use the new seat covering paper P.

An interlock is incorporated circuit-wise in the control unit F and is constructed such that so long as the output from the seating detection means 96 is sent to the control unit F after a predetermined length of the seat covering paper P is delivered, the seat covering paper P is not fed even when the seat covering paper feed switch 103 is turned on.

Therefore, even when the user of the toilet turns on erroneously the seat covering paper feed switch 103 after seating himself on the seat body 11 or when a child turns it on mischievously, the seat covering paper P is not fed out.

The cover opening/closing detection means 98 is connected in series with the power switch S and turns ON and OFF the power switch S when the seat covering paper protection cover 84 is open and closed, respectively.

The other structures in the embodiment shown in the drawings will be explained.

In FIG. 5, reference numerals 120 and 121 represent vent holes through the outer wall **23*a* and the left sidewall 18, respectively in order to permit the inflow of air to cool the motors 40, 75**.

Hereinafter the operation of the seat covering paper automatic feed toilet seat A will be explained with reference to the flow chart in FIGS. 14A to 14D.

Under the state where no power is supplied, the movable plate 50 inside the main casing frame 16 closes the seat covering paper feed port 85 with the front end thereof as shown in FIG. 10 thereby to prevent the contaminated water, etc., from entering the seat covering paper feed path 8 through the seat covering paper feed port 85.

When the flush toilet 10 is used from this state, the power switch S disposed on the back of the main casing frame 16 is turned ON (150) and the power lamp 104 is turned ON (151).

Next, when the seat covering paper feed switch 103 is turned on (152), the operation start signal is inputted to the control unit F and the control unit F generates the driving signal on the basis of the seat covering paper feed/tear sequence program read from the memory M. This driving signal operates sequentially the motor 75 of the seat covering paper tearing mechanism D and the motor 40 of the seat covering paper feed mechanism C.

The movable plate 50 is rotated counter-clockwise due to the clockwise rotation of the disc cam 71 which is rotated by the motor 75 and assumes the position shown in FIG. 4 from the position shown in FIG. 10. In other words, the seat covering paper feed port 85 is opened (157) whereby a portion of the seat covering feed path 8 is defined on the upper surface of movable plate 50.

Thereafter the motor 40 is driven and the seat covering paper P is fed out (158) from the seat covering paper roll R.

If the seat covering paper roll protection cover 84 is not fitted onto the main casing frame 16, the cover opening/closing detection means 98 is OFF so that even if the seat covering paper feed switch 103 push button is pushed (152), the driving signal from the control unit F is not sent (153N) to the motor 40 due to the control of the control unit F whereby safety of operation is assured.

If the user of the toilet seats himself on the seat body 11 (154) under the state where the seat covering paper P is not fed, it is not desirable to feed the seat covering paper P onto the seat body 11. Accordingly, the seating detection means 96 is operated in order not to let the control unit F send (154N) the driving signal to the motor 40.

It is not desirable, either, to feed the seat covering paper P onto the seat body 11 when the latter is kept upright (155). Therefore, if the abnormal feed prevention sensor 97 detects that the seat body 11 is upright, a the driving signal is not sent (155N) to the motor 40.

Furthermore, when the position detection sensor 94 which is disposed inside the functional unit casing 15 detects the seat covering paper P in the seat covering paper feed path 8 inside the functional unit casing 15 (156), the control unit F judges that the feeding of the seat covering paper P would cause entanglement or clogging of the seat covering paper P to or in the functional unit casing 15. Accordingly, its detection output causes the control unit F not to send (156N) any driving signal to the motor 40 (156).

When no abnormal state such as described above exists, the driving signal is sent from the control unit F to the motor 40 to drive it (158) and the seat covering paper P is fed from the seat covering paper roll R.

The timing circuit T (FIG. 13) starts operating (158) simultaneously with the start of driving of the motor 40. Thereafter the position detection sensor 94 detects normally or within the set time $t_1$ the seat covering paper P and detects (159CY) within the set feed time $t_2$ the through-hole 93 disposed on the seat covering paper P.

Then, the motor 40 stops (160) under the state where the seat-covering paper P in the set length has been fed onto the seat main body 11. At this time the breaking line 90 positioned at the rear end of the seat covering paper P is located substantially immediately below the seat covering paper tearing blade 61*a* of the rocking plate 51.

If there is any abnormality in the detection (159*a*) of the position detection sensor 94 described above, that is, when the position detection sensor 94 does not detect (159*a*N) the seat covering paper P within the set time $t_1$, the motor 40 for feeding the seat covering paper P is turned OFF and the paper trouble lamp 106 is lit (161).

If the position detection sensor 94 detects the through-hole 93 earlier than (159*b*) the next timer set time $t_2$ (which is counted from the start of driving of the motor 40), even when it has detected the seat covering paper P within the set time $t_1$ (159*b*Y), the motor 40 is similarly turned OFF and the paper resupply lamp 105 is lit (162).

Furthermore, if the through-hole 93 is not detected within the set feed time $t_2$ (159*c*N), the motor 40 is turned OFF and the paper trouble lamp 106 is lit (163). Thereafter the user can take necesasry measures such as replacement of the paper, inspection, and so forth.

Next, the motor 75 is operated once again by the driving signal from the control unit F and the seat covering paper P is clamped between the seat covering paper press plates 56, 64 and between the feed roller 31 and the clamp roller 32 as shown in FIGS. 7 and 8. Thereafter when the continuous driving signals from the control unit F drive continuously the motor 75, a tension in the feeding direction is applied to the portions of the seat covering paper P corresponding to the portion between both clamp portions (164).

Furthermore, when the motor 75 is driven by the driving signal from the control unit F, the seat covering paper tearing blade 61*a* of the seat covering paper tearing portion 61 of the rocking plate 51 presses the seat covering paper P along the breaking line 90 as shown in FIG. 9 and the seat covering paper P is reliably broken or torn by the pressing force and the tension in the feeding direction (165).

The rear end of the cut seat covering paper P is under the reliably clamped state (165) by the seat covering paper clamping plates 56, 64.

Thereafter, when the user seats himself on the seat body 11 (169), the seating detection means 96 detects his seating (170) and the control unit F makes its control (171) by this detection output in such a manner that even when the seat covering paper feed switch 103 is thereafter pushed, no driving signal is sent to the motor 40 so long as the seating detection means 96 detects seating and the detection output is generated.

Accordingly, even when the user pushes the seat covering paper feed switch 103 either erroneously or mischiveously while seated, the seat covering paper P is not fed so that troubles such as the entanglement of the seat covering paper P inside the functional unit casing 15 can be prevented reliably.

When the user leaves the seat body 11 after use of the toilet (172), the seating detection means 96 is turned OFF (173) and the control unit F again sends the driving signal to the motor 75 on the basis of this OFF signal to drive the motor 75.

Accordingly, the clamping of the seat covering paper P is released (174).

Thereafter the seat covering paper P of the seat body 11 is removed (175) or the flushing device is driven to clean the inside of the flush toilet 10 and the torn portion of the seat covering paper P is caused to flow away together with the flushing water and the sewage by the power of the flushing water.

Then, the motor 40 is driven to feed a predetermined length of the next seat covering paper P such as by 20 mm (176) and the leading edge of the next seat covering paper P is thereby sent foward of the cutting blade 61*a* so that the next feed can be made smoothly even if the leading edge curls. The motor 75 is driven once again to close the seat covering paper feed port 85 (177). In other words, the movable plate 50 assumes the position for preventing reliably the intrusion of the contaminated water into the seat covering paper feed path 8 through the seat covering paper feed port 8*a*, inside the main casing frame 16.

In the steps described above, the flow jumps to the step (174), the clamping of the paper P covering the seat being released to permit the user to discard that seat cover, if the seat covering paper P fed onto the seat body 11 and cut and clamped (165) by the movable plate 50 in cooperation with the rocking plate 51 is wet or otherwise considered unusable by the user or the user does not wish to seat himself on it for any other reason and the seat covering paper feed switch 103 is therefore turned ON by the user (167) or if the user does not seat himself on the seat body 11 within the predetermined time because he considers the seat cover to be unusable or for some other reason (168).

Incidentally, if the seat covering paper roll protection cover 84 is opened as a result of maintenance in order to solve or try to solve any trouble described above, the sub-routine starting from C of FIG. 14C is executed and then the flow returns to E of the main routine.

Figure 14A:
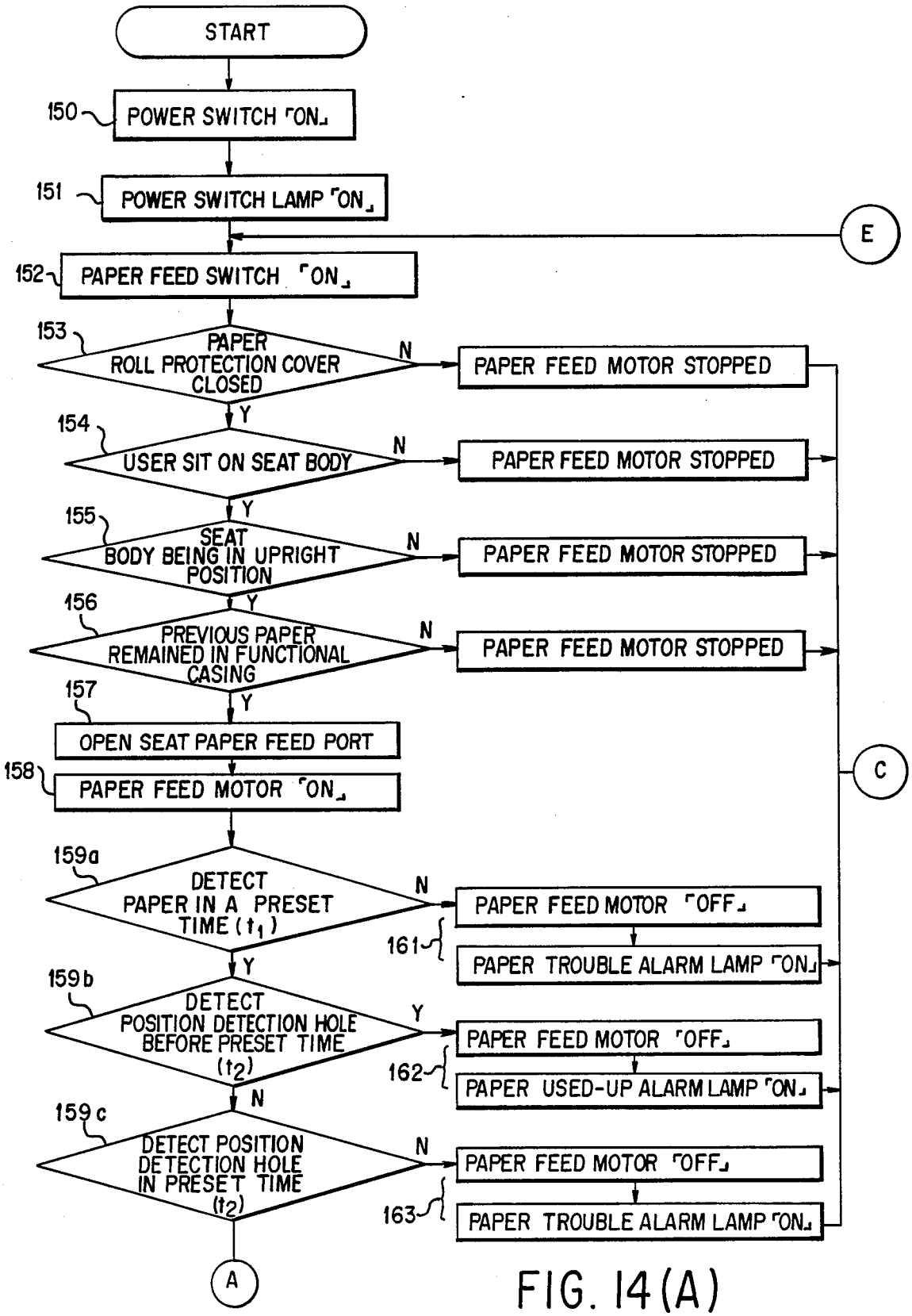
FIGS. 14 A, B, C and D are flow charts showing the process of use of the toilet seat.
Figure 14:
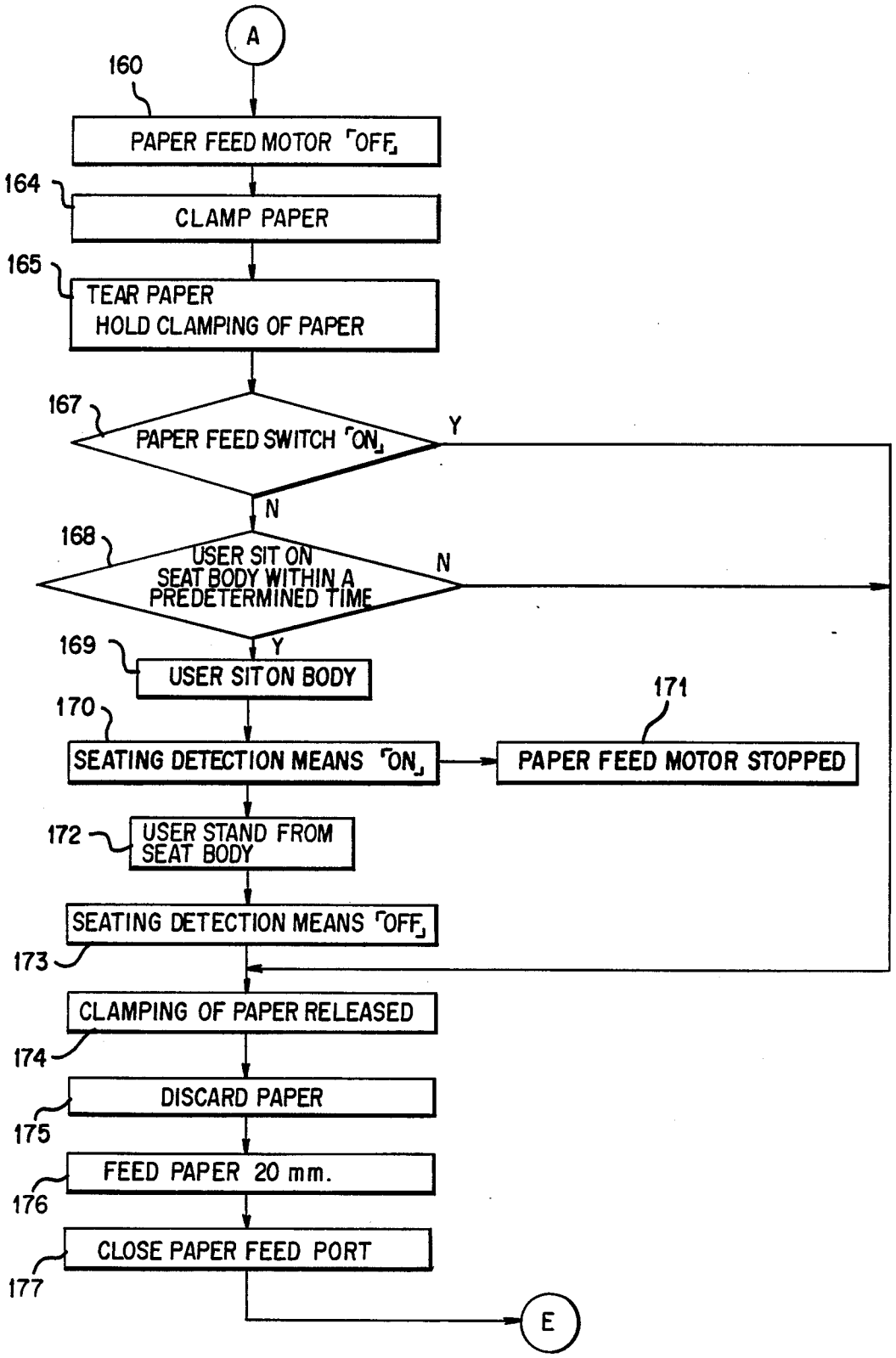
Figure 14C:
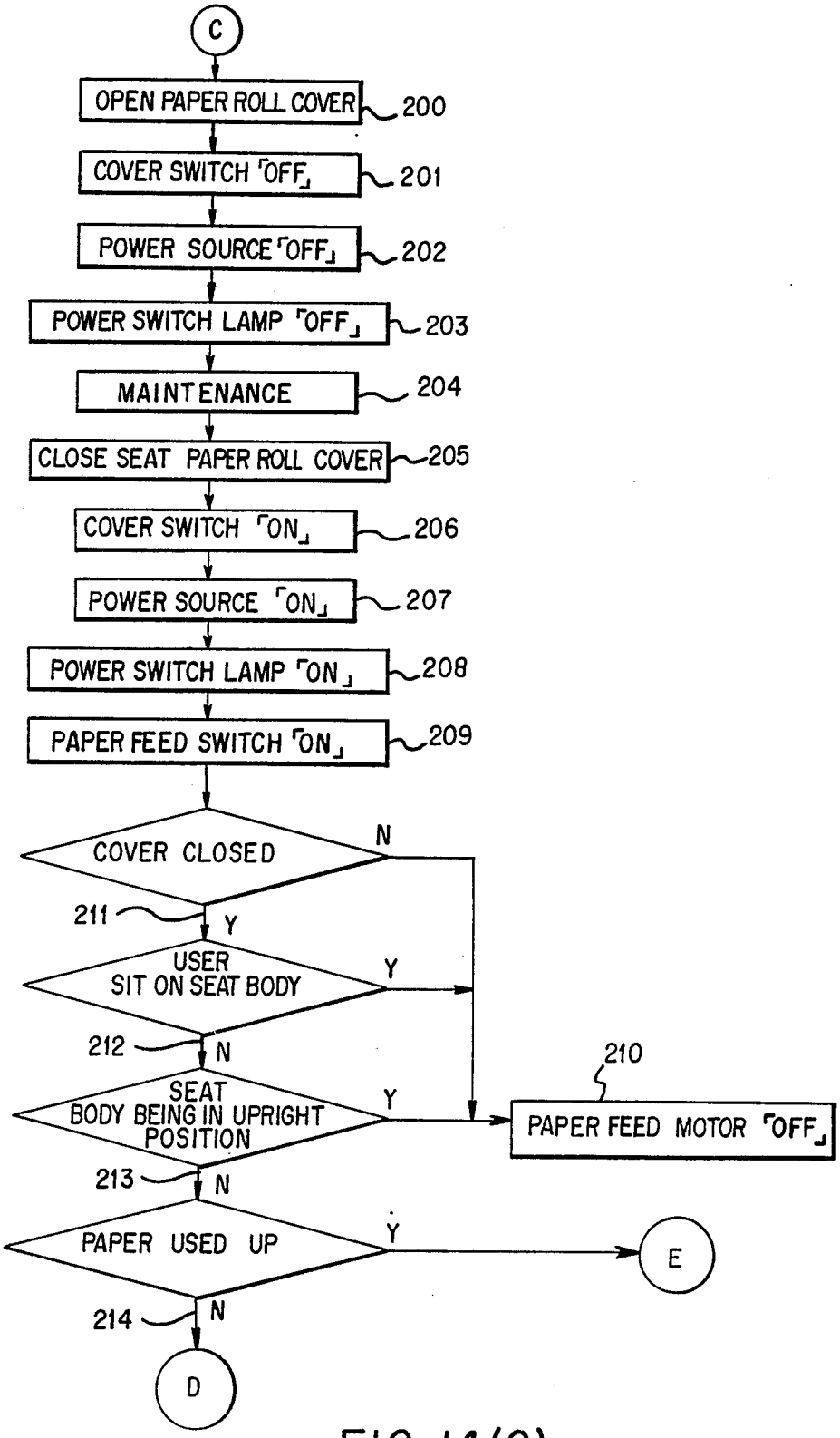
Figure 14D:
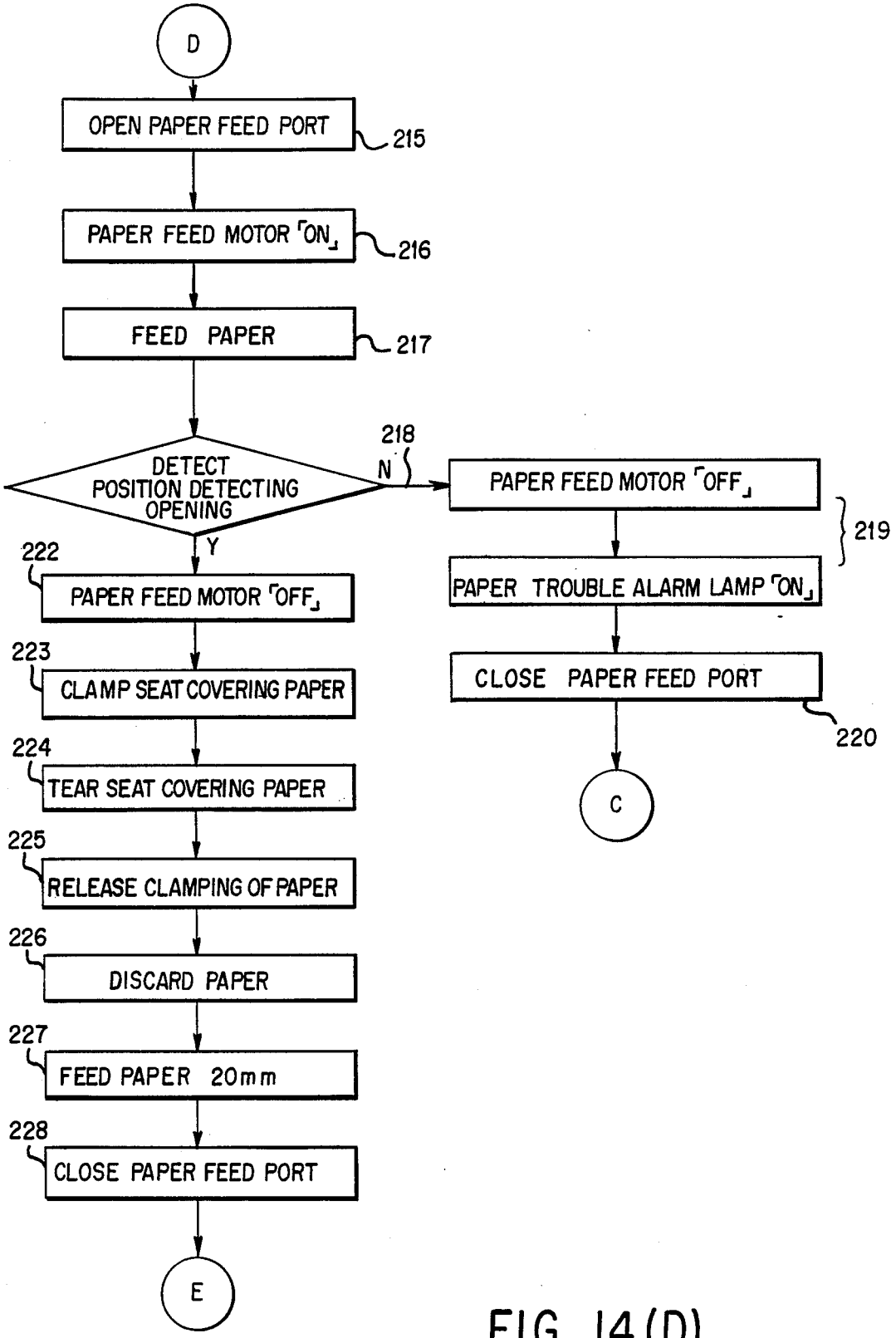

The sub-routine starting from C is shown in FIGS. 14C and D. When the seat covering paper roll protection cover 84 is opened (200) and the output of the cover opening/closing detection means 98 is OFF (201), the power source is turned OFF (202), the power source lamp 104 is OFF (203), the user attends to the maintenance (204), the seat covering paper roll protection cover 84 is closed (205) and the output of the cover opening/closing detection means 98 is ON (206). Then, the power source is ON (207) and the power source lamp 104 is ON (208).

Here, if the seat covering paper feed switch 103 is turned ON (209), the operation start signal is inputted to the control unit F and if the logical product of the following four conditions (1) to (4) is not found established by detection of the state of each portion, the motor 40 is turned OFF because the apparatus has not returned to the normal state and the paper trouble lamp 106 is turned ON so as to promote re-maintenance.

(1) The output of the cover opening/closing detection means 98 of the seat covering paper roll protection cover 84 is ON (211).

(2) The output of the seating detection means 96 is OFF (212).

(3) The output of the abnormal feed prevention sensor 97 of the seat body 11 is OFF (213).

(4) The seat covering paper is set (214).

When the logical product of the four conditions (1) to (4) described above is established, the motor 75 of the seat covering paper cutting mechanism D is rotated so as to cause the movable plate 50 to assume the position shown in FIG. 4, thereby opening the seat covering paper feed port 8*a* (step 215).

Then, the motor 40 of the seat covering paper feeding mechanism C is operated (216) to feed the seat covering paper P (217).

If the position detection through-hole 93 of the seat covering paper P is not detected by the position detection sensor 94 within the time allowance described above during this feed operating of the seat covering paper, the rotation of the motor 40 of the seat covering paper feeding mechanism C is stopped based on the assumption that trouble such as clogging of the paper has occurred, the paper trouble lamp 106 is then lit (219), the seat covering paper feed port 85 is closed (220) and the flow returns to the start of this subroutine.

If the position detection through-hole 93 of the seat covering paper P is detected normally during the feed of the seat covering paper P, the rotation of the motor 40 of the seat covering paper feed mechanism C is stopped (222), the motor 75 of the seat covering paper cutting mechanism D is driven to clamp the seat covering paper P (223), then the paper P is torn (224) and immediately thereafter the clamping of the paper P is released (225) to permit discarding of the paper (226).

Then, in order to insure smooth feed for the next time, the seat covering paper P is fed in a predetermined length (approx. 20 mm) (227), then the motor 75 of the seat covering paper tearing mechanism D is rotated to close the seat covering paper feed port 85 (228) and the flow returns to the stand-by state waiting for the operation of the seat covering paper feed switch (103) of the main routine.

This embodiment provides the following effects because of the structures and actions described above.

When the seat covering paper roll protection cover 84 is opened, the power source is immediately turned OFF and the full functions of the apparatus stop. Therefore, the maintenance such as installation of a new seat covering paper roll R, the elimination of paper clogging, and the like, can be carried out safely. When the seat covering paper roll protection cover 84 is closed after the maintenance described above and the seat covering paper feed switch 103 is pushed, the position detection sensor 94, which has also the function of detecting the paper causes the first seat covering paper P, which has a leading or feed starting end which is not registered with the apparatus, to be fed, torn at the breaking line 90 and unclamped, whereupon the person thus servicing the apparatus discards the first seat covering paper P. Therefore, the seat covering paper P feeding apparatus can be used immediately from the next time in the usual manner.

Particularly, the trouble of repeatedly turning ON and OFF the feed switch in order to register the feed starting end position of the seat covering paper is eliminated.

As will be evidenced from the foregoing description, certain aspects of the invention are not limited to the particular details of constructions as illustrated, and it is contemplated that other modifications and applications will occur to those skilled in the art. For example, the toilet seat structure of this invention may be mounted on a toilet which is provided with device for automatically washing human parts. It is therefore intended that the appended claims shall cover such modifications and applications that do not depart from the true spirit and scope of the invention.

We claim:

1. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, (c) a seat covering paper tearing mechanism for tearing said seat covering paper after said feeding of said seat covering paper and (d) a control unit for controlling said seat covering paper feeding mechanism and said seat covering paper tearing mechanism, said toilet seat structure further comprising tension applying means comprising first clamping means and second clamping means disposed below said seat covering paper roll in a spaced-apart manner in a feeding direction, said tension applying means being capable of applying a tension to a portion of said seat covering paper reeled out from said seat covering paper roll which bridges between said first and second clamping means, and said seat covering paper tearing mechanism comprising a press plate disposed between said first and second clamping means, said press plate being capable of applying pressure on said tensioned portion of said seat covering paper for tearing said seat covering paper.

2. A toilet seat structure capable of automatically feeding a seat covering paper onto a toilet seat according to claim 1, wherein said seat covering paper is provided with a plurality of breaking lines at regular intervals in a feeding direction, each of which comprises a multiplicity of small perforations formed transversly on the entire width of said seat covering paper and said press plate is capable of applying pressure on said covering paper along said breaking lines.

3. A toilet seat structure capable of automatically feeding a seat covering paper onto a toilet seat according to claim 1, wherein said seat covering paper feeding mechanism comprises (a) a seat covering paper feed roller and a seat covering paper clamp roller which are parallelly disposed below said seat covering paper roll protection cover, said rollers biasingly coming into contact with each other to clamp said seat covering paper therebetween thus forming said first clamping means and (B) a drive means operably connected with said seat covering paper feed roller to feed said seat covering paper to the upper surface of said seat body.

4. A toilet seat structure capable of automatically feeding a seat covering paper onto a toilet seat according to claim 3, wherein said seat covering paper tearing mechanism comprises (a) a movable plate disposed in front of said seat covering paper feeding mechanism, said movable plate being rotatable on a pivot shaft in a forward or backward direction and (B) a rocking plate disposed above said movable plate, said rocking plate being operably interlocked with said movable plate and being pivotable on a pivot shaft in a forward and backward direction to come into contact with said movable plate for clamping said seat covering paper fed through a passage formed between said seat covering paper feed roller and said seat covering paper clamping roller, said movable plate and said rocking plate forming said second clamping means, said second clamping means forming said tension applying means together with said first clamping means, said press plate being formed in the rear end of said rocking plate, said press plate being integrally pivotable with said rocking plate for applying pressure to said seat covering paper which is subject to said tension by said tension applying means.

5. A toilet seat structure capable of automatically feeding a seat covering paper onto a toilet seat according to claim 1, wherein said toilet seat structure comprises (a) a functional unit casing which is disposed at the rear end of said seat body and accommodates said seat covering paper feeding mechanism and said seat covering paper tearing mechanism therein and (B) a water barrier disposed at a seat covering paper feeding outlet formed at a front portion of said functional casing, said water barrier being provided for preventing the intrusion of waste or water into the inside of said functional unit casing.

6. A toilet seat structure capable of automatically feeding a seat covering paper onto a toilet seat according to claim 5, wherein said control unit has a control program in which said seat covering paper feeding outlet is closed by said water barrier at a normal condition and upon receiving a seat covering paper feeding output signal, said water barrier is removed to open said seat covering paper feeding outlet.

7. A toilet seat structure capable of automatically feeding a seat covering paper onto a toilet seat according to claim 5, wherein said toilet seat structure is further provided with seating detection means which generates an output when a user seated on said seat body stands up and said control unit has a control program in which when said output is transmitted to said control unit, said clamping of said seat cover is released and said water barrier closes said seat covering paper feeding outlet.

8. A toilet seat structure capable of automatically feeding a seat covering paper onto a toilet seat according to claim 1, wherein said control unit has a control program in which so long as a seating detection means keeps detecting a user sitting on said seat body, said seat covering paper is not fed to said upper surface of said seat body.

9. A toilet seat structure capable of automatically feeding a seat covering paper onto a toilet seat according to claim 1, wherein said control unit has a control program in which a seating detecting means is turned on when a user sits on said seat body after a seat covering paper is fed, clamped and torn and turned off when said user arises from said seat body and said seat paper tearing mechanism continues clamping of said seat covering paper until a turned-off output is transmitted from said seating detecting means to said control unit.

10. A toilet seat structure capable of automatically feeding a seat covering paper onto a toilet seat according to claim 1, wherein said control unit has a control program in which unless a seating detecting means which is connected to said control unit detects sitting of a user on said seat body within a predetermined time after said seat covering paper fed to said seat body is cut and clamped, a clamping releasing output is transmitted to said control unit so as to release a clamping force applied to said seat covering paper.

11. A toilet seat structure capable of automatically feeding a seat covering paper onto a toilet seat according to claim 1, wherein said toilet seat structure is further provided with a position detecting sensor which is connected to said control unit and an alarm generating device for alerting a user to an occurrence of a trouble with the paper and said control unit has a control program in which when said position detecting sensor detects an aperture formed on said seat covering paper, an output is transmitted to said control unit to turn off said seat covering paper feeding mechanism for stopping the feeding of said seat covering paper and when said position detecting sensor does not detect said aperture within a prescribed time, said control unit judges that a trouble with the paper such as a clogging of said seat covering paper has occurred and turns off said seat covering paper feeding mechanism and actuates said alarm generating device.

12. A toilet seat structure capable of automatically feeding a seat covering paper onto a toilet seat according to claim 1, wherein said toilet seat structure is further provided with a position detecting sensor which is connected to said control unit and an alarm generating device for alerting a user to a using up of said seat covering paper and said control unit has a control program in which when said position detecting sensor detects an aperture formed on said seat covering paper well before a predetermined time, an output is transmitted to said control unit and said control unit judges that said seat covering paper is used up and said seat covering paper feeding mechanism is turned off for stopping the feeding of said seat covering paper and actuates said alarm generating device.

13. A toilet seat structure capable of automatically feeding a seat covering paper onto a toilet seat according to claim 1, wherein said toilet seat structure is further provided with a seat covering paper detecting means which is connected to said control unit and said control unit has a control program in which so long as said seat covering paper detecting sensor detects said seat covering paper in a seat paper feeding path, said control unit controls said seat covering paper feeding mechanism not to feed a subsequent seat covering paper toward said seat body.

14. A toilet seat structure capable of automatically feeding a seat covering paper onto a toilet seat according to claim 1, wherein said control unit has a control program in which a seat covering paper feeding switch is turned on to carry out a sequential operation consisting of feeding of said seat covering paper to said seat body, clamping and tearing of said seat covering paper and when said covering paper feeding switch is turned on again, said control unit returns said seat covering paper cutting mechanism to an initial operating condition.

15. A toilet seat structure capable of automatically feeding a seat covering paper onto a toilet seat according to claim 1, wherein said toilet seat structure is further provided with a cover position detecting sensor which is connected to said control unit and said control unit has a control program in which when said cover position detecting sensor detects an opening of aid seat covering paper roll protection cover, a power supply to said toilet seat structure is cut off to turn off said seat covering paper feeding mechanism and said seat covering paper tearing mechanism and when said cover position detecting sensor detects a closing of said seat covering paper roll protection cover and a seat covering paper feeding switch is turned on, a sequential operation consisting of feeding of said seat covering paper to said seat body, clamping and tearing of said seat covering paper is started.

16. A toilet seat structure capable of automatically feeding a seat covering paper onto a toilet seat according to claim 1, wherein said toilet seat structure is further provided with seat body position detecting means which generates an output which is transmitted to said control unit when said detecting means detects said seat body in an upright position, and said control unit has a control program in which so long as said seat body position detecting means keeps generating said output signal, said seat paper feeding mechanism is not operated.

17. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, said seat covering paper feeding mechanism comprising a seat covering paper feed roller and a seat covering paper clamp roller which are parallelly disposed below said seat covering paper roll protection cover, said rollers biasingly coming into contact with each other to clamp said seat covering paper therebetween thus forming a first clamping means and a drive means operably connected with said seat covering paper feed roller to feed said seat covering paper to the upper surface of said seat body, (c) a seat covering paper tearing mechanism for tearing said seat covering paper after said feeding of said seat covering paper and (d) a control unit for controlling said seat covering paper feeding mechanism and said seat covering paper tearing mechanism, said toilet seat structure further comprising tension applying means for applying tension to said seat covering paper and said seat covering paper tearing mechanism comprising a press plate which is capable of applying pressure on said tensioned seat covering paper for tearing said seat covering paper.

18. A toilet seat structure capable of automatically feeding a seat covering paper onto a toilet seat according to claim 17, wherein said seat covering paper tearing mechanism comprises (a) a movable plate disposed in front of said seat covering paper feeding mechanism, said movable plate being rotatable on a pivot shaft in a forward or backward direction, and (B) a rocking plate disposed above said movable plate, said rocking plate being operably interlocked with said movable plate and being pivotable on a pivot shaft in a forward and backward direction to come into contact with said movable plate for clamping said seat covering paper fed through a passage formed between said seat covering paper feed roller and said seat covering paper clamping roller, said movable plate and said rocking plate forming a second clamping means, said second clamping means forming said tension applying means together with said first clamping means, said press plate being formed in the rear end of said rocking plate, said press plate being integrally pivotable with said rocking plate for said applying pressure to said seat covering paper which is subject to said tension by said tension applying means thereby to effect said tearing of said seat covering paper.

19. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll onto the upper surface of the seat body, (c) a seat covering paper tearing mechanism for tearing said seat covering paper after said feeding of said seat covering paper, (d) a control unit for controlling said seat covering paper feeding mechanism and said seat covering paper tearing mechanism, (e) a functional unit casing which is disposed at the rear end of said seat body and accommodates said seat covering paper feeding mechanism and said seat covering paper tearing mechanism therein, and (f) a water barrier disposed at a seat covering paper feeding outlet formed at a front portion of said functional casing, said water barrier being provided for preventing the intrusion of waste or water into the inside of said functional unit casing, said toilet seat structure further comprising tension applying means for applying tension to said seat covering paper and said seat covering paper tearing mechanism comprising a press plate which is capable of applying pressure on said tensioned seat covering paper for tearing said seat covering paper.

20. A toilet seat structure capable of automatically feeding a seat covering paper onto a toilet seat according to claim 19, wherein said control unit has a control program in which said seat covering paper feeding outlet is closed by said water barrier at a normal condition and upon receiving a seat covering paper feeding output signal, said water barrier is removed to open said seat covering paper feeding outlet.

21. A toilet seat structure capable of automatically feeding a seat covering paper onto a toilet seat according to claim 19, wherein said toilet seat structure is further provided with seating detection means which generates an output when a user seated on said seat body stands up and said control unit has a control program in which when said output is transmitted to said control unit, clamping of said seat cover is released and said water barrier closes said seat covering paper feeding outlet.

22. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, (c) a seat covering paper tearing mechanism for tearing said seat covering paper after said feeding of said seat covering paper and (d) a control unit for controlling said seat covering paper feeding mechanism and said seat covering paper tearing mechanism, said control unit having a control program in which a seating detecting means is turned on when a user sits on said seat body after a seat covering paper is fed, clamped and torn and turned off when said user arises from said seat body and said seat covering paper tearing mechanism continues clamping of said seat covering paper until a turned-off output is transmitted from said seating detecting means to said control unit, said toilet seat structure further comprising tension applying means for applying tension to said seat covering paper and said seat paper tearing mechanism comprising a press plate which is capable of applying pressure on said tensioned seat covering paper for tearing said seat covering paper.

23. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, (c) a seat covering paper tearing mechanism for tearing said seat covering paper after said feeding of said seat covering paper and (d) a control unit for controlling said seat covering paper feeding mechanism and said seat covering paper tearing mechanism, said control unit having a control program in which unless a seating detecting means which is connected to said control unit detects sitting of a user on said seat body within a predetermined time after said seat covering paper fed to said seat body is cut and clamped, a clamping releasing output is transmitted to said control unit so as to release a clamping force applied to said seat covering paper, said toilet seat structure further comprising tension applying means for applying tension to said seat covering paper and said seat covering paper tearing mechanism comprising a press plate which is capable of applying pressure on said tensioned seat covering paper for tearing said seat covering paper.

24. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, (c) a seat covering paper tearing mechanism for tearing said seat covering paper after said feeding of said seat covering paper and (d) a control unit for controlling said seat covering paper feeding mechanism and said seat covering paper tearing mechanism, said toilet seat structure further comprising tension applying means for applying tension to said seat covering paper and said seat covering paper tearing mechanism comprising a press plate which is capable of applying pressure on said tensioned seat covering paper for tearing said seat covering paper, said toilet seat structure being further provided with a position detecting sensor which is connected to said control unit and an alarm generating device for alerting a user to an occurrence of a trouble with the paper and said control unit having a control program in which when said position detecting sensor detects an aperture formed on said seat covering paper, an output is transmitted to said control unit to turn off said seat covering paper feeding mechanism for stopping the feeding of said seat covering paper and when said position detecting sensor does not detect said aperture within a prescribed time, said control unit judges that a trouble with the paper such as a clogging of said seat covering paper has occurred and turns off said seat covering paper feeding mechanism and actuates said alarm generating device.

25. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, (c) a seat covering paper tearing mechanism for tearing said seat covering paper after said feeding of said seat covering paper and (d) a control unit for controlling said seat covering paper feeding mechanism and said seat covering paper tearing mechanism, said toilet seat structure further comprising tension applying means for applying tension to said seat covering paper and said seat covering paper tearing mechanism comprising a press plate which is capable of applying pressure on said tensioned seat covering paper for tearing said seat covering paper, said toilet seat structure being further provided with a position detecting sensor which is connected to said control unit and an alarm generating device for alerting a user to a using up of said seat covering paper and said control unit having a control program in which when said position detecting sensor detects an aperture formed on said seat covering paper well before a predetermined time, an output is transmitted to said control unit and said control unit judges that said seat covering paper is used up and turns off said seat covering paper feeding mechanism for stopping the feeding of said seat covering paper and actuates said alarm generating device.

26. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, (c) a seat covering paper tearing mechanism for tearing said seat covering paper after said feeding of said seat covering paper and (d) a control unit for controlling said seat covering paper feeding mechanism and said seat covering paper tearing mechanism, said toilet seat structure further comprising tension applying means for applying tension to said seat covering paper and said seat covering paper tearing mechanism comprising a press plate which is capable of applying pressure on said tensioned seat covering paper for tearing said seat covering paper, said toilet seat structure being further provided with a seat covering paper detecting means which is connected to said control unit and said control unit having a control program in which so long as said seat covering paper detecting sensor detects said seat covering paper in a seat paper feeding path, said control unit controls said seat covering paper feeding mechanism not to feed a subsequent seat covering paper toward said seat body.

27. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, (c) a seat covering paper tearing mechanism for tearing said seat covering paper after said feeding of said seat covering paper and (d) a control unit for controlling said seat covering paper feeding mechanism and said seat covering paper tearing mechanism, said toilet seat structure further comprising tension applying means for applying tension to said seat covering paper and said seat covering paper tearing mechanism comprising a press plate which is capable of applying pressure on said tensioned seat covering paper for tearing said seat covering paper, said control unit having a control program in which a seat covering paper feeding switch is turned on to carry out a sequential operation consisting of feeding of said seat covering paper to said seat body, clamping and tearing of said seat covering paper and, further in which, when said seat covering paper feeding switch is turned on again, said control unit returns said seat covering paper tearing mechanism to an initial operating condition.

28. A toilet seat structure capable of automatically feeding a seat covering paper onto a toilet seat comprising:

(a) a seat covering paper roll in a seat covering paper roll protection cover disposed at the rear end of a toilet seat body, (b) a seat covering paper feeding mechanism for feeding a seat covering paper from said seat covering paper roll to the upper surface of the seat body, (c) a seat covering paper tearing mechanism for tearing said seat covering paper after said feeding of said seat covering paper and (d) a control unit for controlling said seat covering paper feeding mechanism and said seat covering paper tearing mechanism, said toilet seat structure further comprising tension applying means for applying tension to said seat covering paper and said seat covering paper tearing mechanism comprising a press plate which is capable of applying pressure on said tensioned seat covering paper for tearing said seat covering paper, said toilet seat structure being further provided with a cover position detecting sensor which is connected to said control unit and said control unit having a control program in which when said cover position detecting sensor detects an opening of said seat covering paper roll protecting cover, a power supply to said toilet seat structure is cut off to turn off said seat covering paper feeding mechanism and said seat covering paper tearing mechanism and when said cover position detecting sensor detects a closing of said seat covering paper roll protecting cover and a seat covering paper feeding switch is turned on, a sequential operation consisting of feeding of said seat covering paper to said seat body, clamping and tearing of said sheet paper is started.

* * * * *

UNITED STATES PATENT AND TRADEMARK OFFICE

CERTIFICATE OF CORRECTION

PATENT NO. : 4,926,505

DATED : May 22, 1990

INVENTOR(S) : M. Higuchi et al

It is certified that error appears in the above-identified patent and that said Letters Patent is hereby corrected as shown below:

On the title page:

(73) Assignee: Toto Ltd., Kitakyushu, Japan
and
Aichi Electric Co., Ltd., Kasugai, Japan

Signed and Sealed this

Twenty-fourth Day of September, 1991

*Attest:*

HARRY F. MANBECK, JR.

*Attesting Officer*

*Commissioner of Patents and Trademarks*